US009938072B2

(12) United States Patent
Nicmanis

(10) Patent No.: US 9,938,072 B2
(45) Date of Patent: Apr. 10, 2018

(54) FOAM DISPENSER

(71) Applicant: Mark Nicmanis, Cambridgeshire (GB)

(72) Inventor: Mark Nicmanis, Cambridge (GB)

(73) Assignee: Cambridge Consultants Limited, Cambridge, Cambridgeshire (GB)

( * ) Notice: Subject to any disclaimer, the term of this patent is extended or adjusted under 35 U.S.C. 154(b) by 0 days.

(21) Appl. No.: 14/765,502

(22) PCT Filed: Feb. 3, 2014

(86) PCT No.: PCT/GB2014/050297
§ 371 (c)(1),
(2) Date: Aug. 3, 2015

(87) PCT Pub. No.: WO2014/118573
PCT Pub. Date: Aug. 7, 2014

(65) Prior Publication Data

US 2015/0360853 A1 Dec. 17, 2015

(30) Foreign Application Priority Data

Feb. 1, 2013 (GB) ..... 1301875.9

(51) Int. Cl.

| | |
|---|---|
| ***B65D 1/00*** | (2006.01) |
| ***B65D 83/14*** | (2006.01) |
| ***B05B 7/00*** | (2006.01) |
| ***B65D 83/60*** | (2006.01) |
| ***B65D 83/66*** | (2006.01) |
| ***B65D 83/32*** | (2006.01) |

(52) U.S. Cl.
CPC ..... *B65D 83/753* (2013.01); *B05B 7/0025* (2013.01); *B05B 7/0037* (2013.01); *B65D 83/32* (2013.01); *B65D 83/60* (2013.01); *B65D 83/66* (2013.01); *B65D 83/752* (2013.01)

(58) Field of Classification Search
CPC ..... B05B 7/0025; B65D 83/32; B65D 83/60
See application file for complete search history.

(56) References Cited

U.S. PATENT DOCUMENTS 5,842,607 A 12/1998 Snider

FOREIGN PATENT DOCUMENTS

| | | | |
|---|---|---|---|
| AU | 2011253813 | A1 | 1/2012 |
| GB | 2259653 | A | 3/1993 |
| RU | 23387 | U1 | 6/2002 |
| RU | 2344060 | C2 | 1/2009 |
| WO | 3943371 | A1 | 9/1999 |

(Continued)

OTHER PUBLICATIONS

Decision on Grant Patent for Invention (translation of Russian document); Federal Service for Intellectual Jroperty (Rospatent); Russian Application No. 2015137091; Jan. 17, 2018.

*Primary Examiner* — Michael A Salvitti
(74) *Attorney, Agent, or Firm* — Young Basile

(57) ABSTRACT

A dispenser for producing a foam without requiring the use of liquefied gas, from an outlet. The dispenser includes a receptacle for holding a surfactant solution, means for supplying a gas, means for conveying the surfactant solution in the receptacle and said gas along a flow path towards the outlet. The conveying means includes a conduit having a foaming section for generating the foam from the surfactant solution and said gas; and wherein the foaming section has internal dimensions adapted to provide a foam having a quality characterized by predefined limits.

27 Claims, 12 Drawing Sheets

(56) References Cited

FOREIGN PATENT DOCUMENTS

| | | | |
|---|---|---|---|
| WO | 0072821 | A1 | 12/2000 |
| WO | 0241872 | A1 | 5/2002 |
| WO | 2004067392 | A2 | 8/2004 |

FOAM DISPENSER

CROSS REFERENCE TO RELATED APPLICATIONS

The present Invention is a National Stage entry under 35 USC 337 and claims priority to PCT/GB2014/050297 Filed Feb. 3, 2014 which claims priority to GB 1301875.9 filed Feb. 1, 2013, the specifications of which are incorporated herein by reference.

BACKGROUND

The present invention relates to dispensers, in particular foam dispensers capable of producing a foam using a compressed gas.

Common foam and aerosol dispensers produce a foam or an aerosol spray using VOCs, where the VOCs are provided as a liquefied gas which acts as a propellant. For example, many aerosol dispensers use liquefied petroleum gas (LPG) or the like. However, environmental agencies in many different countries are currently attempting to phase out the use of VOCs in such dispensers due to the health risks associated with them, such as sensory irritation and respiratory problems. VOCs are also flammable and more expensive than compressed gas propellants.

Some existing foam dispensers produce foam by passing liquid and gas through small orifices, which results in the formation of bubbles via Rayleigh-Taylor instabilities at a discrete orifice. Due to this mechanism, the smallest size of bubble which can be produced by these small orifice foaming devices is approximately equal to the diameter of the orifice. Hence, to produce small bubbles, for example around 60 microns in diameter, it would be necessary for such small orifice foaming devices to include orifices having diameters of approximately 60 microns.

However, such small orifices can be both difficult and expensive to manufacture. In particular, in order to produce orifices having diameter of less than a millimeter in a material it is typically necessary to use specialized techniques such as laser drilling, which is expensive and not well suited to high volume/low cost manufacture. Also, laser drilling suffers from inherent limits on the aspect ratios of orifices that can be manufactured, where orifice length to width ratios are typically limited to 10 to 1. Therefore, in order to produce a very small orifice via laser drilling (for example of approximately 60 microns in diameter) then such orifices would need to be drilled into a thin material (of approximately 0.6 mm in thickness for an orifice diameter of 60 microns). This in turn places limitations on the materials that can be used These small orifice foaming devices typically include a multitude of small orifices, as the use of only a single small orifice limits the rate at which gas can be incorporated into the foam. In foaming devices which use multiple small orifices, it is necessary to position these orifices at distances of separation equivalent to several orifice diameters in order to prevent the bubbles emerging at the orifices from re-agglomerating into larger bubbles. This requirement means that the small orifices cannot be provided using low cost materials such as fine meshes, sintered materials or porous materials because the orifices in these materials are not sufficiently separated. Therefore, manufacturers must rely on techniques such as laser drilling as explained above.

Also, drawing gas bubbles through a small orifice at a significant rate requires a significant pressure drop across the orifice. This can be created by passing a liquid past the orifice, but in the case of small orifices a high flow rate is required to create a sufficient pressure drop across the orifice. In turn, a significant pressure is required to drive the liquid at a sufficiently high flow rate. Additionally, the rate of gas entrainment into the liquid flow is highly dependent upon the liquid flow rate and the pressure on each side of the orifice, which can result in large variations in bubble sizes and gas phase volumes. For example, where small orifices are used in aerosol-type systems employing a compressed gas propellant the headspace pressure may vary between 0.5 bar and 8 bar, resulting in results in large variations in bubble sizes and gas phase volumes.

Finally, small orifices are very prone to blockages. For example, orifices having diameters of 60 microns can easily become blocked by dust, off-cuts of materials from manufacture, or components of a liquid formulation which can dry and set in the orifice.

To date, it has not been possible to produce satisfactorily high quality foams without the use of VOCs, while ensuring dispensing devices are suitably cost efficient to manufacture.

SUMMARY

A dispenser for producing a micro-foam from an outlet that does not require use of a liquefied gas. The dispenser includes a receptacle for holding a surfactant solution, means for supplying a gas and means for conveying the surfactant solution in the receptacle and the gas along a flow-path towards the outlet. The conveying means includes a conduit having a foaming section for generating the foam from the surfactant solution and the gas. The foaming section has internal dimensions that include an internal welted surface area $A_{ws}$, a two phase flow length $L_{TP}$ a total volume V and a porosity P. The internal dimensions are defined by a relationship between a parameter Y equal to the welted surface area $A_{ws}$ multiplied by the two phase flow length $L_{TP}$ and divided by the volume V, the porosity P, and constants $K_1$ and $K_2$, in which Y is positive and not less than $K_1$ multiplied by P and minus $K_2$ and constants $K_1$ and $K_2$ have values of 1994 and 821 respectively within a 10% tolerance.

BRIEF DESCRIPTION OF THE DRAWINGS

Embodiments of the present invention will now be described, by way of example only, with reference to the following figures, in which.

DETAILED DESCRIPTION

Figure 1:
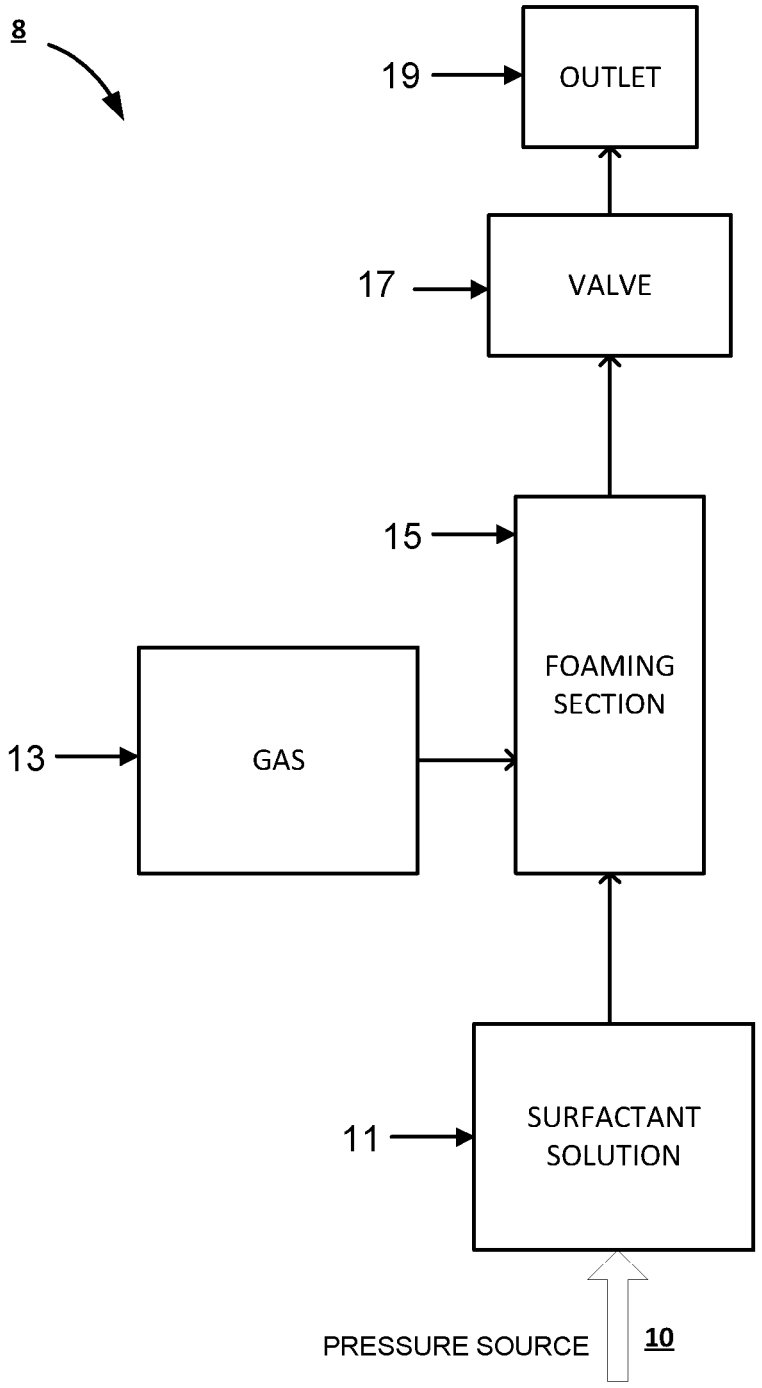
FIG. 1 schematically illustrates, in simplified overview, a dispenser system for dispensing foam.

The present invention aims to address these issues, by providing a device which enables generation of sufficiently high quality foams (e.g. having a relatively high gas phase volume and a relatively small and uniform bubble size) preferably without requiring the use of VOCs.

According to a first aspect, the present disclosed and invention as claimed provides a dispenser for producing a micro-foam without requiring the use of liquefied gas, from an outlet, said dispenser comprising: a receptacle for holding a surfactant solution; means for supplying a gas; means for conveying said surfactant solution in said receptacle and said gas along a flow path towards said outlet; wherein said conveying means comprises a conduit having a foaming section for generating said foam from said surfactant solution and said gas; wherein said foaming section has internal dimensions comprising an internal wetted surface area '$A_{ws}$', a two phase flow length $L_{TP}$ a total volume V and a porosity 'P'; and wherein said internal dimensions are characterized by a relationship between a parameter Y equal to the wetted surface area '$A_{ws}$' multiplied by the two phase flow length $L_{TP}$ and divided by the volume V, the porosity 'P', and constants $K_1$ and $K_2$, in which Y is positive and not less than K1 multiplied by P and minus $K_2$ and constants $K_1$ and $K_2$ have values 1994 and 821 respectively within a 10% tolerance.

The gas may be held at a pressure of between 0.1 bar and 25 bar. The gas may be held at a pressure of between 0.3 bar and 8 bar.

The present disclosure provides a dispenser for producing a foam without requiring the use of liquefied gas, from an outlet, said dispenser comprising: a receptacle for holding a surfactant solution; means for supplying a gas; means for conveying said surfactant solution in said receptacle and said gas along a flow path towards said outlet; wherein said conveying means comprises a conduit having a foaming section for generating said foam from said surfactant solution and said gas; and wherein said foaming section has internal dimensions adapted to provide a foam having a quality characterized by predefined limits.

The foaming section may comprise at least one foam enhancing element disposed in said flow path and the internal dimensions of the foaming section may be provided, at least in part, by the at least one foam enhancing element.

The at least one foam enhancing element may comprise at least one of: a generally spherical element; a generally cuboid element; a generally cylindrical element; a generally conical element; a porous element; and an element extending from an internal surface of the foaming section into said flow path.

The foaming section may further comprise at least one retaining element for retaining the at least one foam enhancing element within the foaming section.

The predefined limits may comprise an average bubble diameter of less than 70 microns.

The predefined limits may comprise an average bubble diameter of less than 60 microns.

The predefined limits may comprise an average bubble diameter of between 30 and 70 microns.

The predefined limits may comprise a uniformity characterized by a standard deviation of less than 35 microns.

The predefined limits may comprise a uniformity characterized by a standard deviation of less than 25 microns.

The predefined limits may comprise a uniformity characterized by a standard deviation of between 10 and 35 microns.

The internal dimensions may comprise a wetted surface area of greater than 1800 square millimeters.

The internal dimensions may comprise a wetted surface area of greater than 3000 square millimeters.

The internal dimensions may comprise a wetted surface area of between 4500 and 6000 square millimeters.

The internal dimensions may comprise a wetted surface area to void space volume ratio of greater than 4 square millimeters per cubic millimeter.

The internal dimensions may comprise a wetted surface area to void space volume ratio of greater than 16 square millimeters per cubic millimeter.

The internal dimensions may comprise a wetted surface area to void space volume ratio of between 20 and 25 square millimeters per cubic millimeter.

The internal dimensions may comprise a wetted surface area to two phase flow length ratio of greater than 3 square millimeters per millimeter.

The internal dimensions may comprise a wetted surface area to two phase flow length ratio of greater than $\pi$ square millimeters per millimeter.

The internal dimensions may comprise a wetted surface area to two phase flow length ratio of greater than 8 square millimeters per millimeter.

The internal dimensions may comprise a two phase flow length of greater than 40 millimeters. The internal dimensions may comprise a two phase flow length of greater than 60 millimeters.

The internal dimensions may comprise a two phase flow length of greater than 1200 millimeters.

The internal dimensions may comprise a foaming section diameter of less than 10 millimeters.

The internal dimensions may comprise a foaming section diameter of less than 4 millimeters.

The internal dimensions may comprise a foaming section diameter of between 0.1 and 10 millimeters.

The predefined limits may comprise a uniformity characterized by a standard deviation of less than 60% of the average bubble diameter.

The predefined limits may comprise a uniformity characterized by a standard deviation of less than 50% of the average bubble diameter.

The receptacle may hold a surfactant solution having a surface tension of below 50 dyne/cm. The receptacle may hold a surfactant solution having a viscosity of below 200 c.P. The receptacle may hold a surfactant solution having a viscosity of below 50 c.P.

The dispenser may further include means for applying pressure to the surfactant solution in said receptacle to drive said surfactant solution along said conduit and towards said foaming section and for driving foam generated by said foaming section to said outlet.

The pressure applying means may be provided by said gas which is held under pressure within said receptacle.

The gas may be held at a pressure of between 2 bar and 25 bar.

The gas may be held at a pressure of between 2 bar and 8 bar.

The concentration of said gas in said surfactant solution may be less than 350 milligrams per kilogram of said surfactant solution.

The gas may comprise a non-liquefied gas. The non-liquefied gas may comprise at least one of: air, nitrogen, carbon dioxide, one or more noble gases, nitrous oxide, oxygen.

The conveying means may comprise a bifurcated tube having a gas inlet and a surfactant solution inlet which meet at a point of bifurcation at which said gas and said surfactant solution mix, in operation, prior to entering the foaming section.

The gas inlet and said surfactant solution inlet may be vertically separated from one another.

The point of bifurcation may be configured to generally remain below the liquid level of the surfactant solution.

The dispenser may be configured to produce a foam without using volatile organic compounds, VOCs.

The gas supplying means and the conveying means are operable to provide said gas and said surfactant solution to the foaming section with fluid characteristics comprising a superficial gas velocity '$V_G$' and a superficial liquid velocity '$V_L$'; wherein said fluid characteristics are characterized by a relationship between superficial gas velocity '$V_G$', the superficial liquid velocity '$V_L$', and constants $C_1$ and $C_2$, in which $V_G$ is not more than $C_1$ multiplied by $V_L$ and added to $C_2$, and constants $C_1$ and $C_2$ have values 18.4 and 507.4 respectively within a 10% tolerance.

According to another aspect of the present disclosure there is provided a dispenser for producing a micro-foam without requiring the use of liquefied gas, from an outlet, said dispenser comprising: a receptacle for holding a surfactant solution; means for supplying a gas; means for conveying said surfactant solution in said receptacle and said gas along a flow path towards said outlet; wherein said conveying means comprises a conduit having a foaming section for generating said foam from said surfactant solution and said gas; wherein said gas supplying means and said conveying means are operable to provide said gas and said surfactant solution to the foaming section with fluid flow characteristics comprising a superficial gas velocity '$V_G$' and a superficial liquid velocity '$V_L$'; and wherein said fluid flow characteristics are characterized by a relationship between superficial gas velocity '$V_G$', the superficial liquid velocity '$V_L$', and constants $C_1$ and $C_1$, in which $V_G$ is not more than $C_1$ times $V_L$ plus $C_2$ and constants $C_1$ and $C_2$ have values 18.4 and 507.4 respectively within a 10% tolerance.

Said gas supplying means and said conveying means may be operable to provide said gas and said surfactant solution to the foaming section with fluid flow characteristics characterized by said relationship between superficial gas velocity '$V_G$', the superficial liquid velocity '$V_L$', and constants $C_1$ and $C_2$ by means of adjusting at least one of: a pressure applied to at least one of the gas and the surfactant solution; a diameter of a fluid flow path.

According to another aspect of the present disclosure there is provided a foaming component, for a foam dispenser, for producing a foam without requiring the use of liquefied gas, said foaming element comprising: means for conveying a surfactant solution from a receptacle and a gas along a flow path; wherein said conveying means comprises a conduit having a foaming section for generating said foam from said surfactant solution and said gas; wherein said foaming section has internal dimensions comprising an internal wetted surface area '$A_{ws}$', a two phase flow length $L_{TP}$, a total volume V and a porosity 'P'; and wherein said internal dimensions are characterized by a relationship between a parameter Y equal to the wetted surface area 'Aws' multiplied by the two phase flow length $L_{TP}$ and divided by the volume V, the porosity 'P', and constants $K_1$ and $K_2$, in which Y is positive and not less than $K_1$ multiplied by P and minus $K_2$ and constants $K_1$ and $K_2$ have values 1994 and 821 respectively within a 10% tolerance.

According to another aspect of the present disclosure there is provided a foaming component, for a foam dispenser, for producing a foam without requiring the use of liquefied gas, said foaming element comprising: means for conveying a surfactant solution from a receptacle and a gas along a flow path; wherein said conveying means comprises a conduit having a foaming section for generating said foam from said surfactant solution and said gas; and wherein said foaming section has internal dimensions adapted to provide a foam having a quality characterized by predefined limits.

According to another aspect of the present disclosure there is provided a dispenser for producing a foam without requiring the use of liquefied gas, from an outlet, said dispenser comprising: a receptacle for holding a surfactant solution; means for supplying a gas; means for conveying said surfactant solution in said receptacle and said gas along a flow path towards said outlet; wherein said conveying means comprises a conduit having a foaming section for generating said foam from said surfactant solution and said gas; and wherein said foaming section has internal dimensions conforming to at least one of the following parameters: a wetted surface area of greater than 1800 square millimeters; a wetted surface area to void space volume ratio of greater than 4 square millimeters per cubic millimeter; a foaming section diameter of less than 10 millimeters; and a two phase flow length of greater than 40 millimeters. The gas may be held at a pressure of between 2 bar and 8 bar.

According to another aspect of the present disclosure there is provided a method of producing a foam without requiring the use of liquefied gas, using a foam dispenser as described above, or using a foaming component as described above.

According to another aspect of the present disclosure there is provided a foam produced without requiring the use of liquefied gas, using a foam dispenser as described above, or using a foaming component as described above.

The foam may comprise at least one of the one of the following limits: an average bubble diameter of less than 70 microns; an average bubble diameter of less than 60 microns; an average bubble diameter of between 30 and 70 microns; a standard deviation of less than 35 microns; a standard deviation of less than 25 microns; a standard deviation of between 10 and 35 microns.

According to another aspect of the present disclosure there is provided a method of producing a foam without requiring the use of liquefied gas, said method comprising: holding, in a receptacle, a surfactant solution; conveying said surfactant solution in said receptacle and a gas from a gas supply along a flow path towards an outlet; wherein said conveying step comprises conveying said surfactant solution and said gas in a conduit having a foaming section for generating said foam from said surfactant solution and said gas; wherein said foaming section has internal dimensions comprising an internal wetted surface area '$A_{ws}$', a two phase flow length $L_{TP}$ a total volume V and a porosity 'P'; and wherein said internal dimensions are characterized by a relationship between a parameter Y equal to the wetted surface area '$A_{ws}$' multiplied by the two phase flow length $L_{TP}$ and divided by the volume V, the porosity 'P', and constants $K_1$ and $K_1$, in which Y is positive and not less than $K_1$ multiplied by P and minus $K_2$ and constants $K_1$ and $K_1$ have values 1994 and 821 respectively within a 10% tolerance.

According to another aspect of the present disclosure there is provided a method of producing a foam without requiring the use of liquefied gas, said method comprising: holding, in a receptacle, a surfactant solution; conveying said surfactant solution in said receptacle and a gas from a gas supply along a flow path towards an outlet; wherein said conveying step comprises conveying said surfactant solution and said gas in a conduit having a foaming section for generating said foam from said surfactant solution and said gas; wherein said gas and said surfactant solution are provided to the foaming section with fluid flow characteristics comprising a superficial gas velocity '$V_G$' and a superficial liquid velocity 'VL'; and wherein said fluid flow characteristics are characterized by a relationship between superficial gas velocity '$V_G$', the superficial liquid velocity '$V_L$', and constants $C_1$ and $C_2$, in which $V_G$ is not more than $C_1$ times $V_L$ plus $C_2$ and constants $C_1$ and $C_2$ have values 18.4 and 507.4 respectively within a 10% tolerance.

Said gas and said surfactant solution may be provided to the foaming section with fluid flow characteristics characterized by said relationship between superficial gas velocity '$V_G$', the superficial liquid velocity '$V_L$', and constants $C_1$ and $C_2$ by adjusting at least one of: a pressure applied to at least one of the gas and the surfactant solution; a diameter of a fluid flow path.

According to another aspect of the present disclosure there is provided a dispenser for producing a micro-foam without requiring the use of liquefied gas, from an outlet, said dispenser comprising: a receptacle for holding a surfactant solution; a gas supply for supplying a gas; a channel for conveying said surfactant solution in said receptacle and said gas along a flow path towards said outlet; wherein said channel comprises a conduit having a foaming section for generating said foam from said surfactant solution and said gas; wherein said foaming section has internal dimensions comprising an internal wetted surface area 'Aws'. a two phase flow length $L_{TP}$, a total volume V and a porosity 'P'; and wherein said internal dimensions are characterised by a relationship between a parameter Y equal to the wetted surface area 'Aws' multiplied by the two phase flow length $L_{TP}$ and divided by the volume V, the porosity 'P', and constants $K_1$ and $K_2$, in which Y is positive and not less than $K_1$ multiplied by P and minus $K_2$ and constants $K_1$ and $K_2$ have values 1994 and 821 respectively within a 10% tolerance.

According to another aspect of the present disclosure there is provided a dispenser for producing a micro-foam without requiring the use of liquefied gas, from an outlet, said dispenser comprising: a receptacle for holding a surfactant solution; a gas supply for supplying a gas; a channel said surfactant solution in said receptacle and said gas along a flow path towards said outlet; wherein said channel comprises a conduit having a foaming section for generating said foam from said surfactant solution and said gas; wherein said gas supply and said channel are operable to provide said gas and said surfactant solution to the foaming section with fluid flow characteristics comprising a superficial gas velocity '$V_G$' and a superficial liquid velocity '$V_L$'; and wherein said fluid flow characteristics are characterized by a relationship between superficial gas velocity '$V_G$', the superficial liquid velocity '$V_L$', and constants $C_1$ and $C_2$, in which $V_G$ is not more than $C_1$ times $V_L$ plus $C_2$ and constants $C_1$ and $C_2$ have values 18.4 and 507.4 respectively within a 10% tolerance.

According to another aspect of the present disclosure there is provided a method of producing a foam without requiring the use of liquefied gas, said method comprising: holding, in a receptacle, a surfactant solution; conveying said surfactant solution in said receptacle and a gas from a gas supply along a flow path towards an outlet; wherein said conveying step comprises conveying said surfactant solution and said gas in a conduit having a foaming section for generating said foam from said surfactant solution and said gas; and wherein said foaming section has internal dimensions adapted to provide a foam having a quality characterized by predefined limits.

According to another aspect of the present disclosure there is provided a dispenser for producing a foam, from an outlet, said dispenser comprising: a receptacle for holding a surfactant solution; means for supplying a gas; means for conveying said surfactant solution in said receptacle and said gas along a flow path towards said outlet; wherein said conveying means comprises a conduit having a foaming section for generating said foam from said surfactant solution and said gas; and wherein said foaming section has internal dimensions adapted to provide a foam having a quality characterized by predefined limits.

FIG. 1 schematically illustrates, in simplified overview, a dispenser system 8 according to the present invention. The dispenser system comprises a supply of a surfactant solution 11 (or a solution comprising another appropriate foaming agent) and a gas supply 13. The surfactant solution 11 and gas supply 13 are in fluid communication with a foaming section 15 which is configured for mixing the surfactant solution with the gas provided by the gas supply 13 to form a foam having the desired properties. The foaming section 15 is in fluid communication with an outlet 19 via a valve 17, to allow the foamed mixture of surfactant solution and gas to be conveyed from the foaming section 15 to the outlet 17 where the foam can exit the dispenser system 8. Advantageously, the foaming section 15 is configured to produce a foam formed from bubbles which are substantially smaller than the smallest orifice size in the foaming section. This means that small bubbles, having for example diameters of approximately 60 microns, can be created without the need to manufacture very small apertures, for example of a diameter close to 60 microns.

Pressure is applied to the surfactant solution 11, from a suitable source 10, in order to drive the surfactant solution 11 into the foaming section 15. Although not illustrated, it will be appreciated that the same source of pressure 10, or a separate source of pressure, may be applied to drive the gas 13 into the foaming section 15. The surfactant solution 11 comprises a liquid surfactant, while the gas held in the gas supply comprises, in this embodiment, a non-liquefied gas, providing a compressed gas propellant. Advantageously, the gas does not need to contain volatile organic compounds (VOCs).

As the gas 13 is not provided in liquefied form, in examples where the gas 13 and surfactant solution 11 are stored in the same receptacle only comparably small amount of gas, or none, will be present in the surfactant solution 11 (generally in dissolved form), in contrast to foam dispensers which use liquefied gas propellants. In examples where the gas 13 and surfactant solution 11 are stored in different receptacles, their flow paths may be combined, for example, at a T-connector or a Y-connector prior to entering the foaming section 15.

In use, therefore, both the surfactant solution and the gas enter the foaming section 15, causing the surfactant solution and the gas to combine to form a foam comprising bubbles of the gas within the liquid surfactant, having predefined desired characteristics.

In particular, the dispenser system 8 is configured to produce a "micro-foam". This is defined as a foam in which the bubbles themselves cannot be resolved by the human eye and therefore the foam appears continuous.

Foams in which the bubbles themselves cannot be resolved by the human eye typically have an average bubble diameter of below 100 microns, and a high degree of uniformity.

Typically, micro-foams will have the characteristics outlined below.

The micro-foams will have a relatively high gas phase volume, typically greater than 90% for surfactant solutions. For micro-foams formed from milks, the gas phase volume will be greater than 75%, and for micro-foams formed from dairy creams the gas phase volume will be greater than 60%.

In order to be invisible to the naked eye, an average bubble diameter smaller than 100 microns will be sufficient in most cases, although for a particularly high quality micro-foam the average bubble diameter will be preferably smaller than 40 microns.

The bubble size distributions will have a high degree of uniformity, typically having a standard deviation of less than 25 microns.

A good quality micro-foam produced by a foaming device will preferably have the characteristics described above, and will be a smooth and continuous foam, without the presence of relatively large bubbles (for example over one millimeter in diameter), or air pockets.

For many applications, for example, the following characteristics are generally desirable: a target gas phase volume that is relatively high (typically, for example, in excess of 90% or more preferably in excess of 95%), a relatively small average bubble diameter (typically, for example, below 100 microns, more preferably below 70 and further more preferably around 60 microns or even lower, or between 30 and 70 microns), a low standard deviation in the bubble diameter (typically, for example, below 35 microns and more preferably in the region of 25 microns plus or minus 2 microns, or an even lower value, or between 10 and 35 microns). Furthermore, the standard deviation may represent less than 60% of the average bubble diameter, or more preferably less than 50% of the average bubble diameter.

The pressure exerted on the surfactant by the source of pressure 10, as well as driving the surfactant held to enter the foaming section 15, also drives the foam held within the foaming section 15 to pass into the valve 17 and to exit the dispensing system 8 at the outlet 19. If a source of pressure other than the source of pressure 10 is used to propel the gas 13 into the foaming section 15, then this separate source of pressure also helps to drive the foam held within the foaming section 15.

The valve 17 can occupy an open or closed position. When the valve 17 is in the open position the foam is allowed to flow from the foaming section 15 to the outlet 19, and when the valve 17 is in the closed position the flow of foam from the foaming section 15 to the outlet 19 is prevented or restricted. In this way, the valve 17 controls the dispensing of foam from the dispensing system 8.

By way of example only, in one exemplary foam, produced in initial experimentation, the foam formed has a mean bubble diameter of approximately 60 microns, and a standard deviation in bubble diameter of approximately 25 microns at a time approximately 3 seconds after the foam has been dispensed from the dispensing system 8.

Furthermore, in further experimentation, it was found that the dispenser system 8 illustrated in FIG. 1 was capable of producing a "micro-foam" when the foaming section 15 conformed to particular parameters. Specifically, a number of parameters were identified in further experimentation as being a strong indicator of whether a foaming section 15 can produce a micro-foam, and the quality of micro-foam which can be produced. These parameters will now be briefly introduced. The parametric space found to produce micro-foams generally and which affect the quality of the micro-foams will be described in more detail later with respect to the experiments used to derive them.

It was found that porosity is an important parameter for determining whether a foaming section 15 can produce a good quality micro-foam. Porosity is defined as the proportion of empty space within a foaming section 15 with respect to the total volume of the foaming section. For example, the porosity of a hollow tube is 1.

It was found that the wetted surface area Aws of the foaming section 15 is an important parameter for determining whether a foaming section 15 can produce a micro-foam, in particular a parameter denoted Y which is equal to wetted surface area $A_{ws}$ multiplied by the two phase flow length $L_{TP}$ and divided by the total volume V of the foaming section.

$$Y = \frac{A_{WS} L_{TP}}{V}$$

In the following discussion, it is assumed that the foaming section has a constant cross sectional area $A_{CS}$ and therefore the parameter Y is equivalent to the ratio $R_{WS\text{-}CS}$ of wetted surface area $A_{WS}$ to cross sectional area $A_{CS}$ of the foaming section 15.

$$R_{WS-CS} = \frac{A_{WS}}{A_{CS}}$$

The wetted surface area Aws is defined as the total surface area within the foaming section, including any foam enhancing elements (also referred to as packing material). In the case of a foaming section formed from a tube packed with foam enhancing elements the wetted surface area $A_{WS}$ is the area of the inside surface of the tube plus the total surface area of the foam enhancing elements. In the case of a foaming section formed from a porous material the wetted surface area $A_{WS}$ is the surface area of all the pores through which liquid and gas can flow. The cross sectional area $A_{CS}$ is the total area of a section through the foaming section, taken perpendicular to the overall direction of fluid flow.

It was found that the superficial velocity of the gas 13 and the surfactant solution 11 are important parameters for determining whether a foaming section 15 can produce a good quality micro-foam. Superficial velocity is defined as the velocity of the gas or liquid through the empty space in the foaming section i.e. Superficial velocity=$Q/(\epsilon\ A_{CS})$ where: Q is the volumetric flow-rate of the gas or liquid; $\epsilon$ is the porosity of the foaming section; $A_{CS}$ is the cross sectional area of the foaming section. It is noted that that when calculating the superficial velocity of the liquid or gas, the presence of the other phase is ignored, e.g. the superficial gas velocity is calculated assuming no liquid is present in the system and vice versa. Also, in examples where the foaming section does not have a constant cross sectional area, the parameter $A_{CS}$ is replaced with $V/L_{TP}$.

Advantageously, the system 8 of FIG. 1 is configured such that the ratio $R_{WS\text{-}CS}$ of wetted surface area $A_{WS}$ to cross sectional area $A_{CS}$ of the foaming section 15, the porosity of the foaming section 15, and the superficial velocities of the gas 13 and surfactant solution 11 are in a parametric space, as described in more detail later, which ensures that a good quality micro-foam can be produced from the dispensing system 8.

Figure 2:
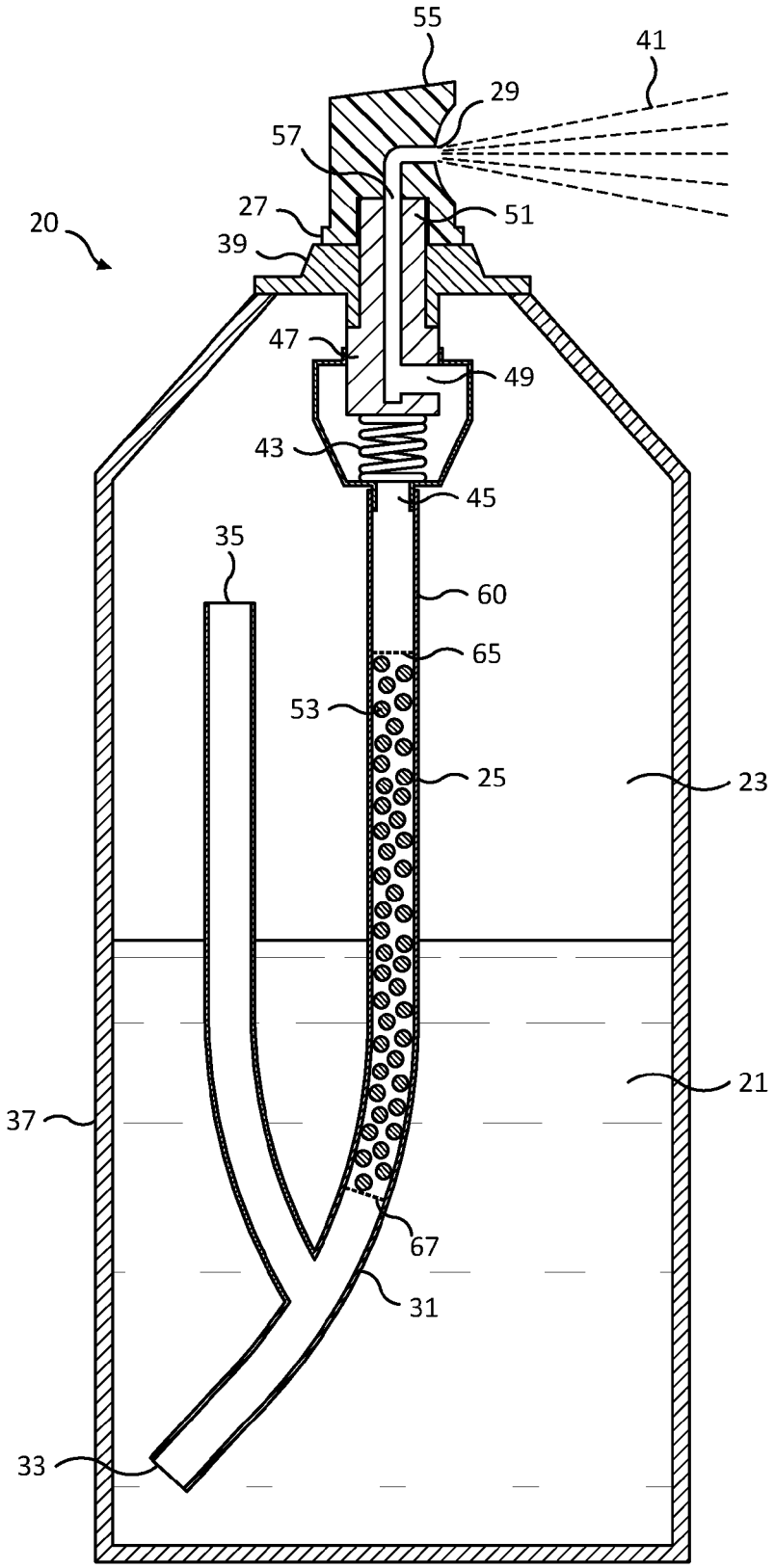
FIG. 2 illustrates, in simplified form, a specific embodiment of a dispensing device for dispensing a foam.

FIG. 2 illustrates an embodiment of a dispensing device 20. The dispensing device 20 comprises a container in the form of an enclosed receptacle 37 for holding a surfactant solution 21 and a compressed gas propellant 23 under pressure, which are mixed, in operation, by the dispensing device to form a foam 41. The receptacle 37 has an opening 39 which is sealed by a valve 27. The valve 27 forms an airtight seal with the receptacle 37 in order that, when the valve is closed, neither the compressed gas propellant 23 nor the surfactant solution 21 can exit the receptacle 37. This is particularly important as in this embodiment the use of a compressed gas propellant means that the pressure within the receptacle 37 will be higher than the atmospheric pressure surrounding the receptacle.

As illustrated, in this embodiment the receptacle 37 acts as both a gas supply and a surfactant solution supply (e.g. performing the functions of both the supply of surfactant solution 11 and the gas supply 13 of FIG. 1).

The valve 27 comprises a valve inlet 45 and a valve stem 47 which is moveably connected to the valve 27 in a slidable manner. The valve stem 47 comprises a valve stem inlet 49 disposed near a lower end of the valve stem 47 and a valve outlet 57 disposed near an upper end of the valve stem 47, the valve stem inlet 49 and the valve outlet 57 being in fluid communication via a channel 51. The valve stem 47 can be moved between an open position and a closed position. In the open position, fluid communication is permitted between the valve inlet 45 and the valve outlet 57, via the valve stem inlet 49 and the channel 51. When the valve stem 47 is in its closed position, such fluid communication is prevented due to the sealing of the valve stem inlet 49 caused by the engagement of the valve stem inlet 49 with a surface of the valve 27. The valve stem 47 is biased into the closed position by a spring 43.

The dispensing device further comprises an actuator 55 mounted to the valve stem 47 for actuating the valve under pressure from a user. The actuator 55 comprises a nozzle 29 for directing foam which exits the valve outlet 57 to discharge the foam from the dispensing device 20.

As shown in FIG. 2, a fluid conduit 60 is provided, in the receptacle 37, for communicating the surfactant solution 21 and the gas 23 to a foaming section 25 of the conduit 60 and for communicating foam from the foaming section 25 to the valve 27. The fluid conduit 60, in this embodiment, comprises a bifurcated tube having a gas inlet section 35 arranged for receiving the gas and a liquid inlet section 33 arranged for receiving the surfactant solution. The gas and liquid inlet sections 33, 35 converge at a manifold 31 at the junction of the bifurcated tube to conduct the gas 23 and surfactant solution 21 respectively into a common section of the fluid conduit 60, in which common section the foaming section 25 is provided. Hence, in this example, the foaming section 25 is downstream from the liquid and gas inlet sections 33, 35. In this embodiment, the foaming section 25 of the fluid conduit 60 extends from the bifurcation of the fluid conduit 60 to an end of the fluid conduit distal from the bifurcation, said end at which the fluid conduit 60 connects to the valve 27.

Preferably, the length of the foaming section 25 is greater than 10 mm and more preferably is in the range of 50 to 70 mm.

As illustrated, the liquid inlet section 33 extends proximate to the base of the receptacle 37, while the gas inlet section 35 extends proximate to the top of the receptacle 37. This arrangement ensures that, when the dispensing device 20 is oriented in its upright position (as illustrated in FIG. 2), the surfactant solution 21, which has a higher density than the compressed gas propellant 23, will occupy a lower part of the receptacle 37, while the compressed gas propellant 23 will occupy the remaining part at the top of the receptacle 37 not occupied by the surfactant solution, referred to as the headspace. However, it is noted that when the dispensing device 20 is held in a different orientation, in particular an "upside down" orientation, gas inlet section 35 may serve as a liquid inlet section and the liquid inlet section 33 may serve as a gas inlet section.

As mentioned previously, the compressed gas propellant 23, due to its compressed nature, creates a pressure inside the receptacle 37 which is higher than the atmospheric pressure which exists outside the receptacle. The compressed gas propellant 23 therefore exerts a force on the surfactant solution 21. Preferably, the pressure of the gas propellant in the headspace is above 0.1 bar, and more preferably is above 2 bar, and preferably below 25 bar. As the liquid inlet 33 is located below the liquid level of the surfactant solution (as illustrated in FIG. 2), the force exerted on the surfactant solution 21 by the compressed gas propellant 23 drives the surfactant solution 21 to enter the foaming section 25 via the liquid inlet section 33. As the gas inlet section 35 is located above the liquid level of the surfactant solution, the compressed gas propellant is able to enter the foaming section 25 via the gas inlet 35.

When the valve 27 is closed, i.e. when the valve stem 47 occupies its closed position, the dispensing device 20 is sealed and no surfactant solution nor gas propellant is permitted to exit the dispensing device 20. However, when the valve 27 is opened, i.e. when the valve stem 47 occupies its open position, the surfactant solution 21 and the gas propellant 23 are able to exit the dispensing device 20 via the valve outlet 57 and nozzle 29. In this situation, due to the force exerted on the surfactant solution 21 by the compressed gas propellant 23, the surfactant solution 21 is drawn into the foaming section 25 via the liquid inlet 33 and the manifold 31. The action of the surfactant solution 21 passing the gas inlet of the manifold 31 causes the gas propellant 23 to be drawn into the flow stream of surfactant solution and thus into the manifold 31 and the foaming section 25. Also, gas is driven to enter the flow steam by the headspace pressure of in the receptacle 37.

In this embodiment, the foaming section 25 comprises a number of foam enhancing elements 53 disposed within the foaming section 25 and along the flow path of the surfactant solution and the gas propellant. The presence of the foam enhancing elements 53 within the foaming section 25 result in the foaming section 25 having parameters which ensure the foaming section is capable of producing a micro-foam. In particular, the ratio $R_{WS\text{-}CS}$ of wetted surface area $A_{WS}$ to cross sectional area $A_{CS}$, the porosity of the foaming section 25, and the superficial velocities of the gas 23 and the surfactant solution 21 through the foaming section 25 are configured to produce a micro-foam.

Figure 11:
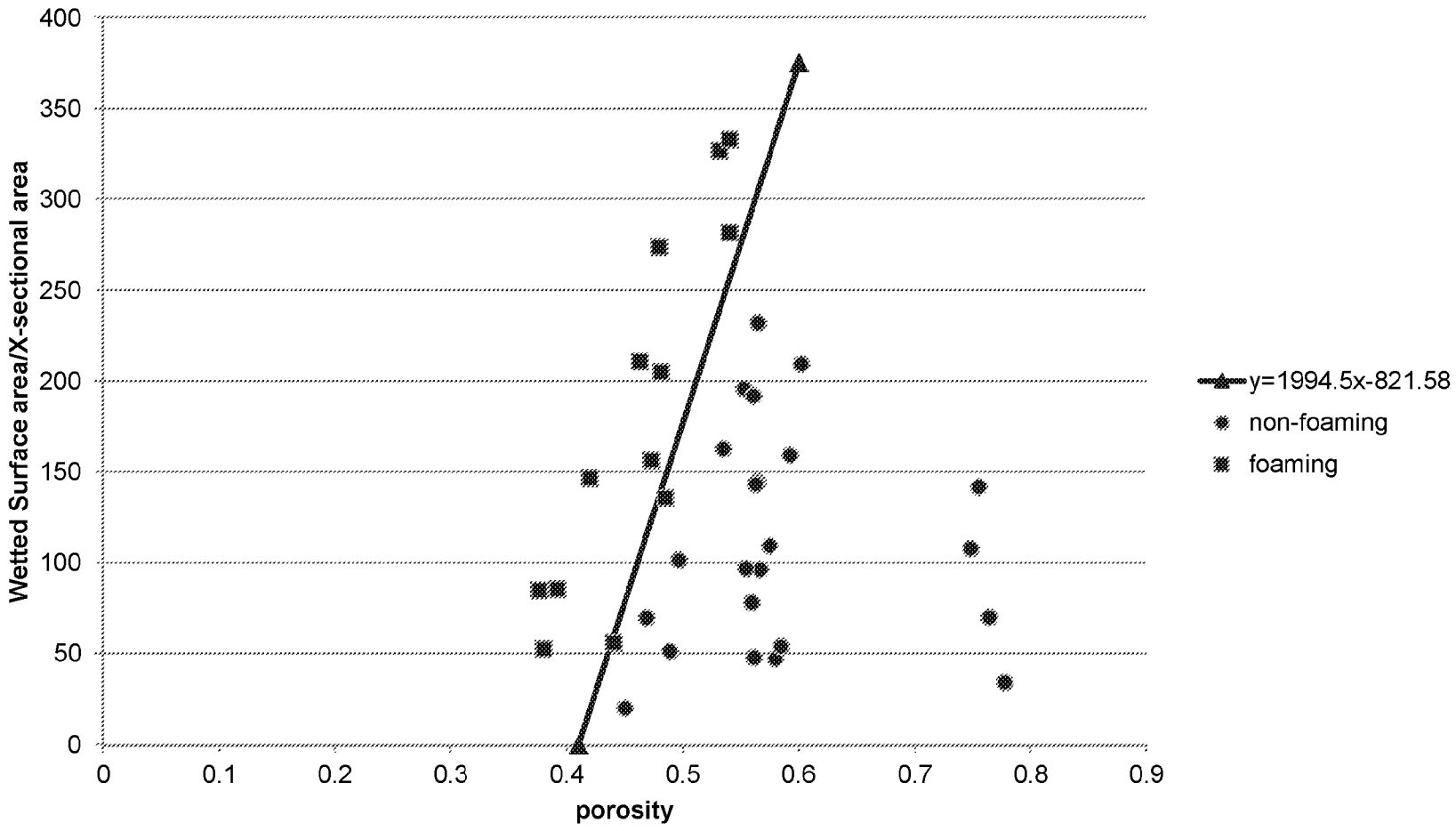
FIG. 11 is a graph illustrating dimensional characteristics of the foaming device required to provide a foam.
Figure 12:
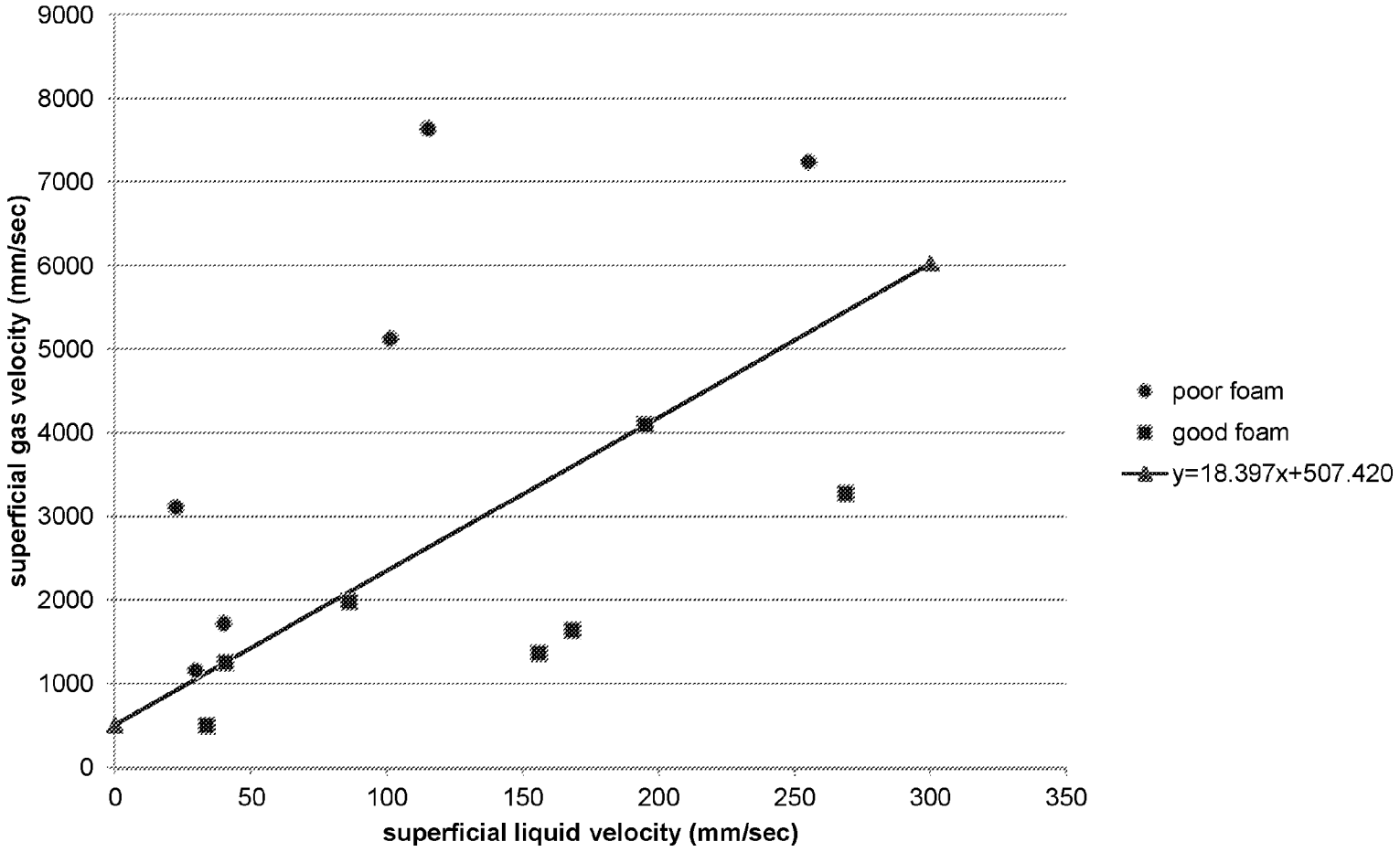
FIG. 12 is a graph illustrating fluid characteristics required to provide a foam of a desired quality.

Initial experimentation indicated that the presence of the foam enhancing elements 53 within the foaming section 25 enables the foaming section 25 to conform to at least key parameters 1 and 2 of Table 1, while using a foaming section of appropriate dimensions (e.g. a length of less than 70 mm) so that it may fit easily within say a typically sized aerosol can (e.g. 100-200 mm in height). Further experimentation helped to further define the parameters required to produce an acceptable micro-foam and the parameters that affected the quality of the micro-foam (e.g. as indicated in FIGS. 11 and 12).

Initial experimentation indicated that the wetted surface area to two phase flow length ratio is greater than 3 square millimeters per millimeter, or more preferably greater than π square millimeters per millimeter. A higher wetted surface area to two phase flow length ratio may be preferable for producing a desired foam, for example greater than 8 square millimeters per millimeter.

In this example, foam enhancing elements 53 comprise a plurality of generally spherical beads of glass (or other suitable material such as a plastic material).

The foaming section 25 also includes retainers 65 and 67 which are disposed at opposing ends of the foaming section 25. The retainers 65, 67 are located within the flow path of the foaming section 25, and are formed from a mesh-like material, in order to allow surfactant solution 21 and gas 23 (along with a foam comprising the surfactant solution and the gas) to pass through and thus travel along the fluid conduit 60. However, the retainers 65, 67 inhibit movement of the foam enhancing elements 53 along the fluid conduit 60, thus maintaining the position of the foam enhancing elements 53 and preventing their discharge from the dispensing device 20.

While the valve 27 remains open, the foam 41 formed from the surfactant solution 21 and gas propellant 23 is conveyed through the foaming section 25 and into the valve 27 via the valve inlet 45. The open configuration of the value 27 allows the foam to pass through the valve, and the foam 41 is then discharged from the dispensing device 20 at the actuator outlet 29.

The presence of the foam enhancing elements 53 causes improved mixing of the gas 23 with the surfactant solution 21 and enhances the formation of the foam 41 (for a given foaming section tube shape and/or dimensions) by causing the parameters of the foaming section 25 to lie within the parametric space identified in the further experimentation. Also, the foam enhancing elements 53 may increase the wetted surface area to void space volume ratio within the foaming section 25.

It was found in initial experimentation that by varying the geometry of the foaming section 25 including the foam enhancing elements 53, the wetted surface area Aws may be tailored to provide a foam having particular required characteristics. In particular, it was found in the initial experimentation that the ratio of the wetted surface area $A_{WS}$ of the foaming section 25 to the volume of the void space of the foaming section 25, through which the surfactant solution and gas passes, affects the quality of the foam produced. Accordingly, this ratio may be tailored to provide a foam having particular required characteristics. Other parameters found in the initial experimentation to have a potential effect on foam quality include: the internal diameter of the foaming section 25; surface area to two phase flow length ratio; the internal diameter of the liquid inlet; the internal diameter of the gas inlet; the surface tension of the surfactant; the viscosity of the surfactant; the pressure (e.g. headspace pressure) applied to the gas and/or surfactant (or the ratio of such pressures); and the length of the fluid conduit from the manifold to the outlet (provided that the wetted surface area to void space volume ratio in the conduit remains above an appropriate threshold for the type of foam being produced).

It was found in the initial experimentation that having an internal foaming section 25 surface area of at least 1,800 square millimeters provides a foam of sufficiently high quality for many applications. A higher wetted surface area Aws may be preferable for producing a desired foam, for example greater than 3000 square millimeters or greater than 3700 square millimeters. Nevertheless, particularly high quality foams can be produced using a much higher surface area, for example between 4500 and 6000 square millimeters. A wetted surface area to void space volume ratio of at least 4 square millimeters per cubic millimeter has been found to provide a foam of sufficiently high quality for many applications. A higher wetted surface area to void space volume ratio may be preferable for producing a desired foam, for example greater than 16 square millimeters per cubic millimeter. Nevertheless, particularly high quality foams can be produced using a much higher ratio, for example between 20 and 25 square millimeters per cubic millimeter.

Figure 3:
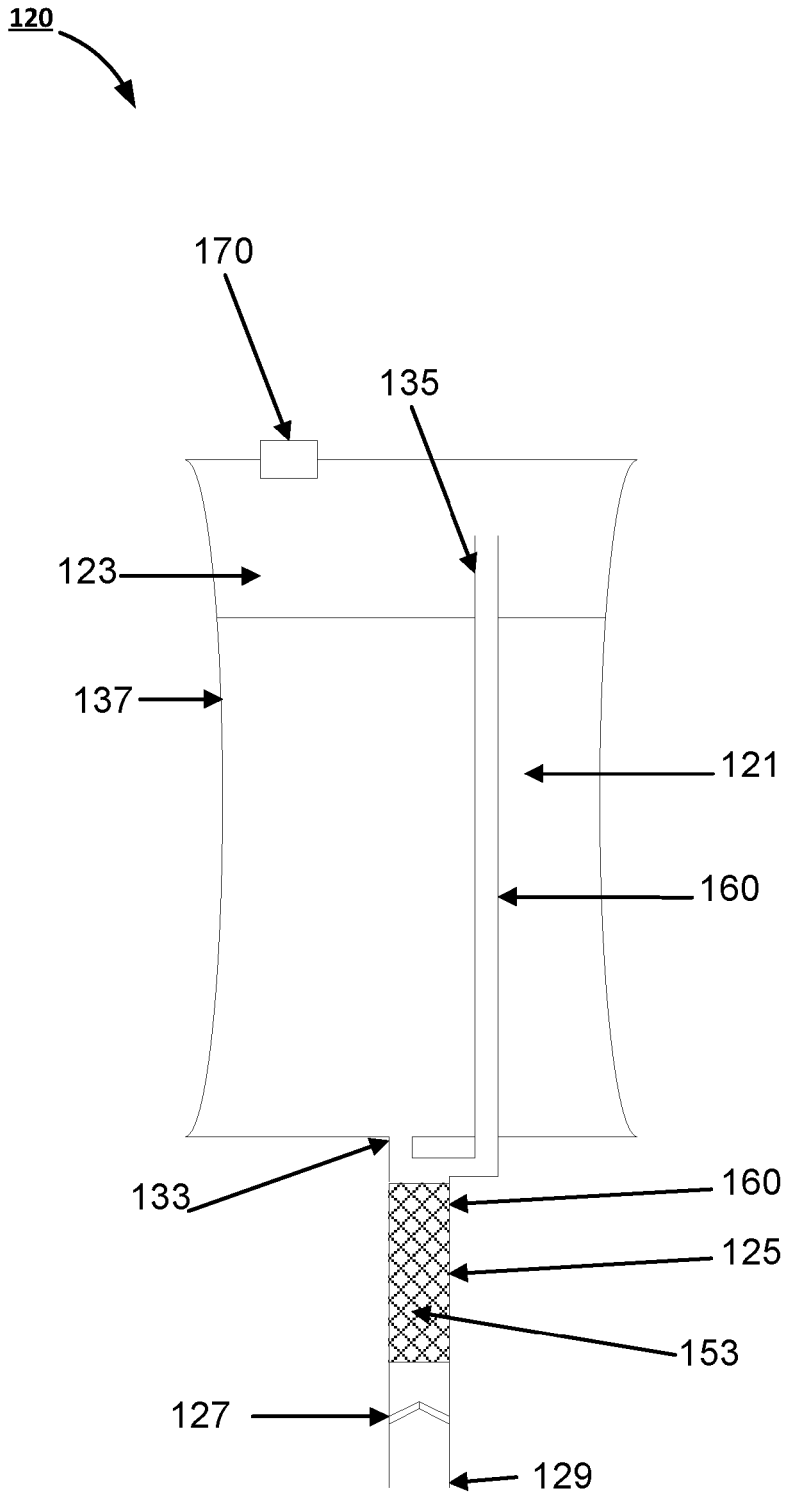
FIG. 3 illustrates, in simplified form, another embodiment of a dispensing device for dispensing a foam.

FIG. 3 is a simplified illustration of a section through a dispensing device 120 according to a further embodiment. A container comprising a receptacle 137 is provided which is adapted to hold a supply of surfactant solution 121 and a supply of gas 123. In this embodiment, the gas 123 is not a compressed gas propellant and instead is provided at a pressure similar to that of the ambient air surrounding the dispensing device 120. The dispensing device 120 includes a liquid inlet 133 located proximate to the bottom of the receptacle 137, and further includes a gas inlet 135 located proximate to the top of the receptacle 137. This arrangement ensures that when the dispensing device 120 is oriented in its upright position, as illustrated in FIG. 3, the liquid inlet 133 will be located below the liquid level of the surfactant solution, while the gas inlet will be located above the liquid level of the surfactant solution thereby allowing gas to enter the gas inlet 135. Preferably, the liquid inlet 133 is located at the lowest point of the receptacle 137 in order to ensure that all of the surfactant solution 121 held within the receptacle 137 is able to enter the liquid inlet 133.

The dispensing device 120 includes a one-way valve 170 which is configured to allow ambient air to enter into the receptacle 137 and to restrict or prevent gas 123 and surfactant solution 121 from exiting the receptacle 137. In this embodiment, the one-way valve 170 is disposed near or at the top of the receptacle 137 in order that air which enters into the receptacle 137 via the one-way valve 170 does so above the level of the surfactant solution, thus inhibiting the creation of bubbles of air within the surfactant solution 121.

The dispensing device 120 further comprises a foaming section 125 which is in fluid communication with the liquid inlet 133 and connected to the gas inlet 135 via a tube 160 which allows fluid communication between the foaming section 125 and the gas inlet 135.

In common with the foaming section 25 described above in relation to FIG. 2, the foaming section 125 comprises a number of foam enhancing elements 135 which allow generation of a high quality foam formed from the surfactant solution 121 and the gas 123, beneficial within a relatively short length of foaming section. In this embodiment, the gas 123 is preferably air. It will be appreciated that, in other embodiments, a similar high quality foam, having the described desired characteristics, can be produced without the use of foam enhancing elements 153.

The foaming section 125 is connected to and in fluid communication with an outlet 129 from which the foam generated in the foaming section can be dispensed. A valve 127 controls the flow of foam from the foaming section 125 to the outlet 129 and is preferably configured to only allow foam to flow from the foaming section 125 to the outlet 129 when the foam exerts a pressure above a threshold pressure on the valve 127.

In order to drive both the gas 123 and the surfactant solution 121 to enter the foaming section 125, a pressure must be applied to the gas 123 and the surfactant solution 121. In this exemplary embodiment, the receptacle 137 is flexible and preferably to some extent collapsible, as indicated by the curved sides of the receptacle 137. The pressure can therefore be applied to the gas 123 and to the surfactant 121 by compressing the receptacle 137 and thus decreasing the volume of the receptacle 137. This action may be performed by hand or alternatively apparatus may be provided for compressing the receptacle 137; such an apparatus is not illustrated in FIG. 3, but such apparatus could comprise a hand operated pump configured to engage with the outlet 129 and use suction to draw out the contents of the receptacle 137.

Figure 4:
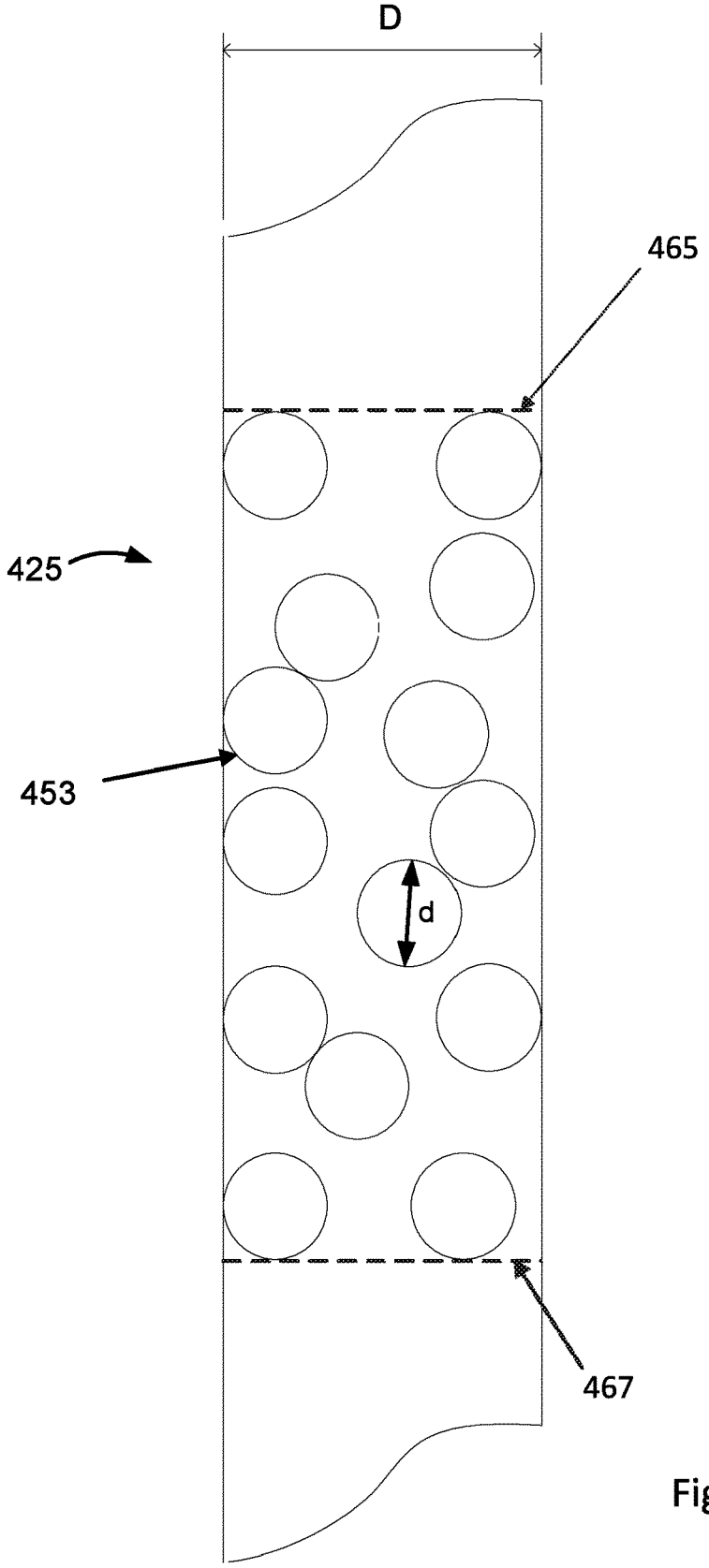
FIG. 4 illustrates, in simplified form, part of a foaming section of a dispensing device.

FIG. 4 illustrates, in simplified form, part of a foaming section 425 which can, for example, be provided as part of the dispensing device illustrated in any of the Figures, or supplied separately. The foaming section 425 is only shown in part, as indicated by the cutaway lines at the top and bottom of the foaming section. As shown, the foaming section 425 comprises a number of foam enhancing elements 453 which are held within the fluid conduit 460 and in the flow path of the surfactant and the gas which are carried through the foaming section. In this embodiment, the foam enhancing elements 453 comprise a plurality of generally spherical glass beads.

The foaming section 425 also includes retainers 465, 467 which are equivalent to retainers 65, 67 shown in FIG. 2.

As shown, each of the foam enhancing elements 453 have a diameter, denoted d, where d is preferably in the range of 0.5 to 2 mm and more preferably in the range of 1 to 1.3 mm. Preferably, the average value of d for the plurality of foam enhancing elements 453 is in the range of 1 to 1.5 mm and more preferably in the vicinity of 1.23 mm, plus or minus 0.10 mm. The diameter of each of the foam enhancing elements 453 is advantageously less than ⅓ of the inner diameter of the tube which forms the foaming section of the fluid conduit. Beneficially, this helps to prevent undesirably large voids being left around the inner circumferential surface of the tube which would prevent the wetted surface area to void space volume ratio from obtaining a sufficiently high value.

As illustrated in FIG. 4, the foaming section 425 has an internal diameter, denoted D. Preferably, D in a diameter of the foaming section 425 is between 0.1 mm and 10 mm, and more preferably is less than 4 mm, for example between 2 mm and 4 mm.

Figure 5:
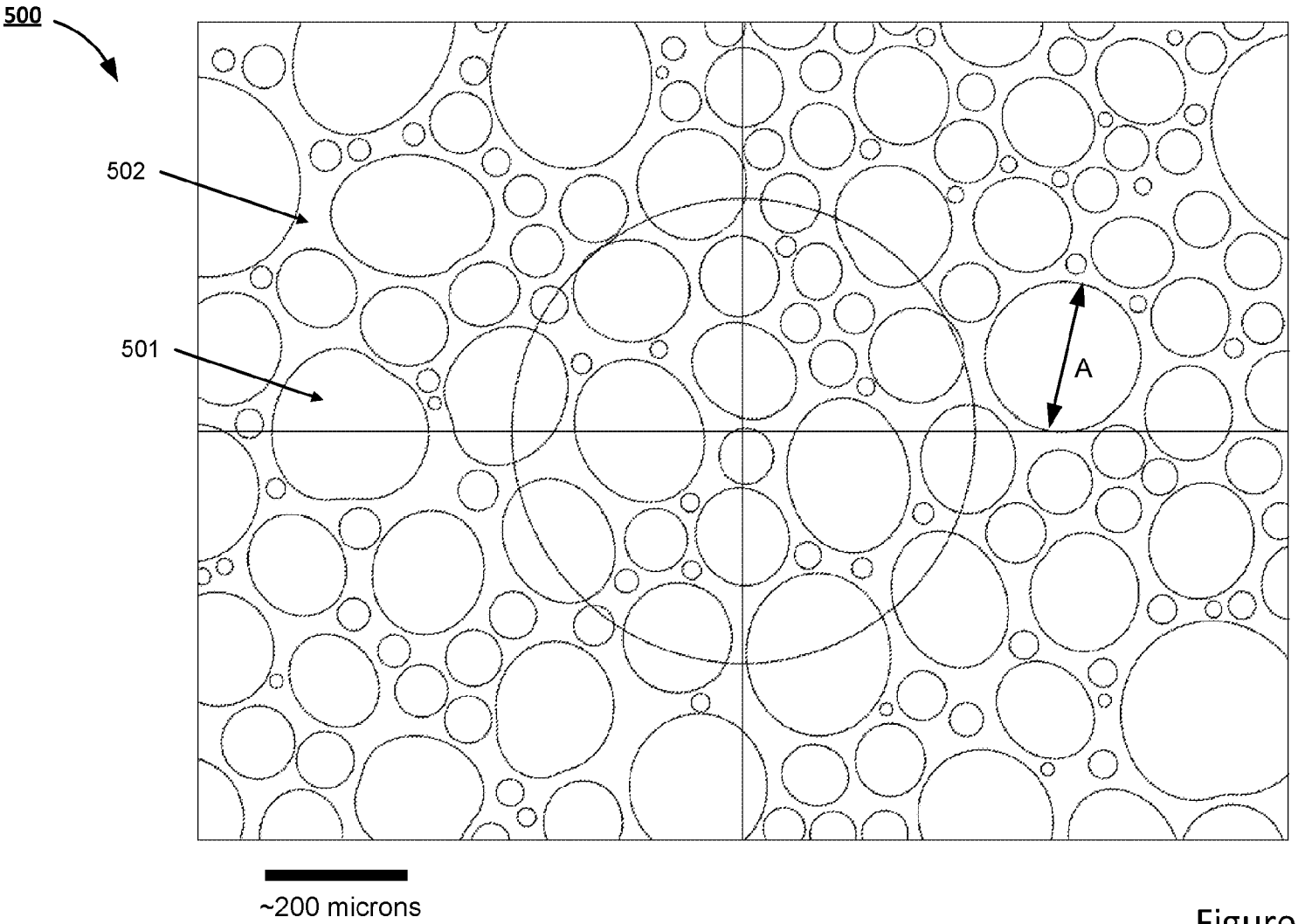
FIG. 5 illustrates, in a simplified manner, a sample of foam created using a known foam dispenser.

FIG. 5 illustrates, in a simplified manner, a sample of foam 500 created using known techniques, (see steps 9 to 12 of the initial experimental method, below) in order to determine typical characteristics of known foams for comparison purposes. As shown in FIG. 5, the foam 500 comprises a plurality of air bubbles 501 held within a surfactant solution 502. Each air bubble 501 has a diameter, denoted by label "A" in FIG. 5. In the sample of foam 500 illustration FIG. 5, the mean bubble diameter is 80 microns, and the standard deviation of the bubble diameters is 60 microns. The largest bubble in the illustrated sample has a diameter of 278 microns.

Figure 6:
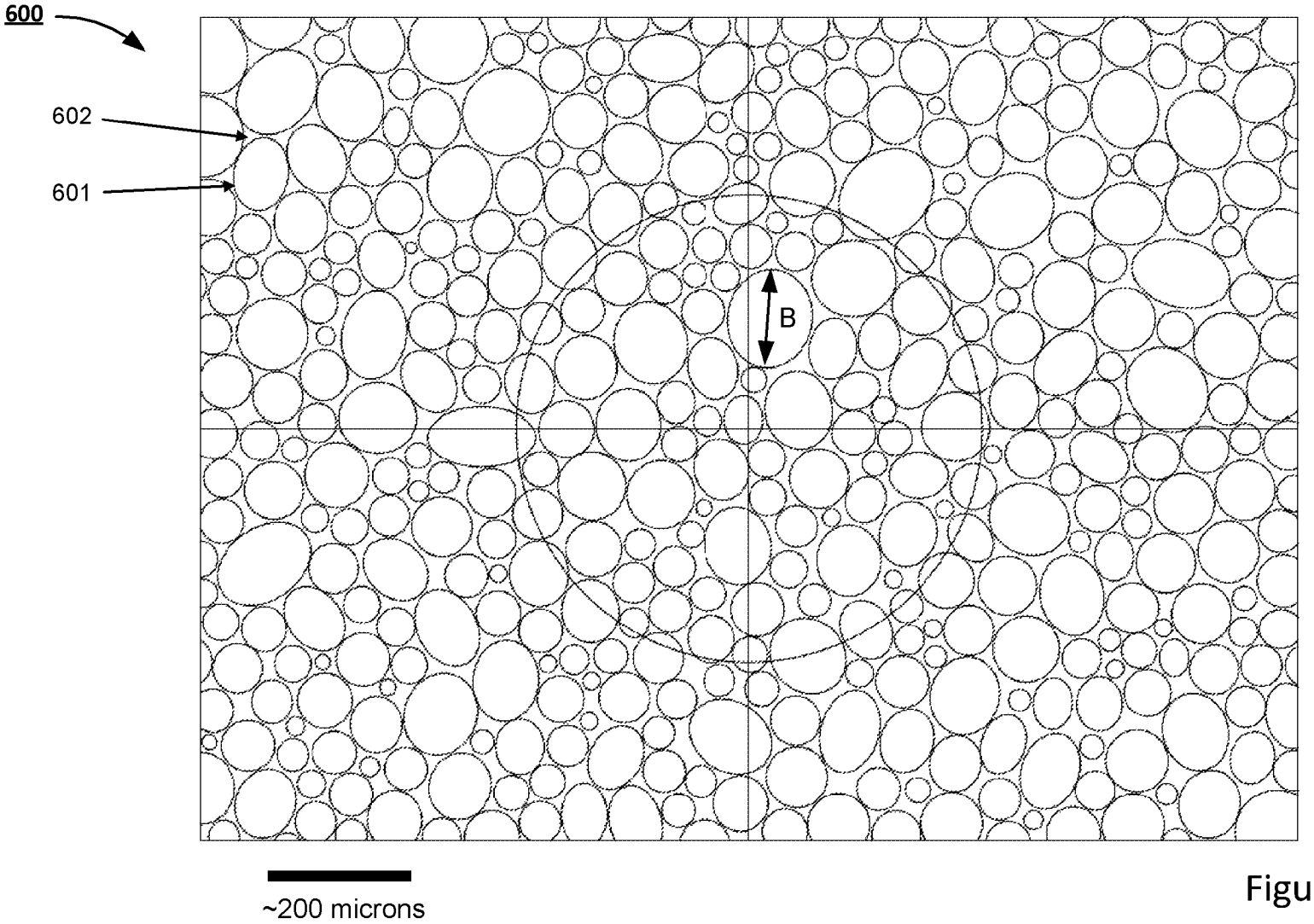
FIG. 6 illustrates, in a simplified manner, a sample of foam created using a dispensing device substantially corresponding to the dispensing device illustrated in FIG. 2.

FIG. 6 illustrates, in a simplified manner, a sample of foam 600 created in the initial experimentation using a dispensing device substantially corresponding to the dispensing device illustrated in FIG. 2. The foam, 600, was created according to a method described in steps 1-8 of the initial experimental method, below. The foam 600 comprises a plurality of bubbles 601 of nitrogen held within a surfactant solution 602. Each bubble 601 has a diameter, denoted "B" in FIG. 6. The mean bubble diameter in the illustrated sample of foam 600 is 60 microns and the standard deviation in bubble diameter is 25 microns. The largest bubble in the foam sample 600 illustrated in FIG. 6 has a diameter of 130 microns.

Figure 7:
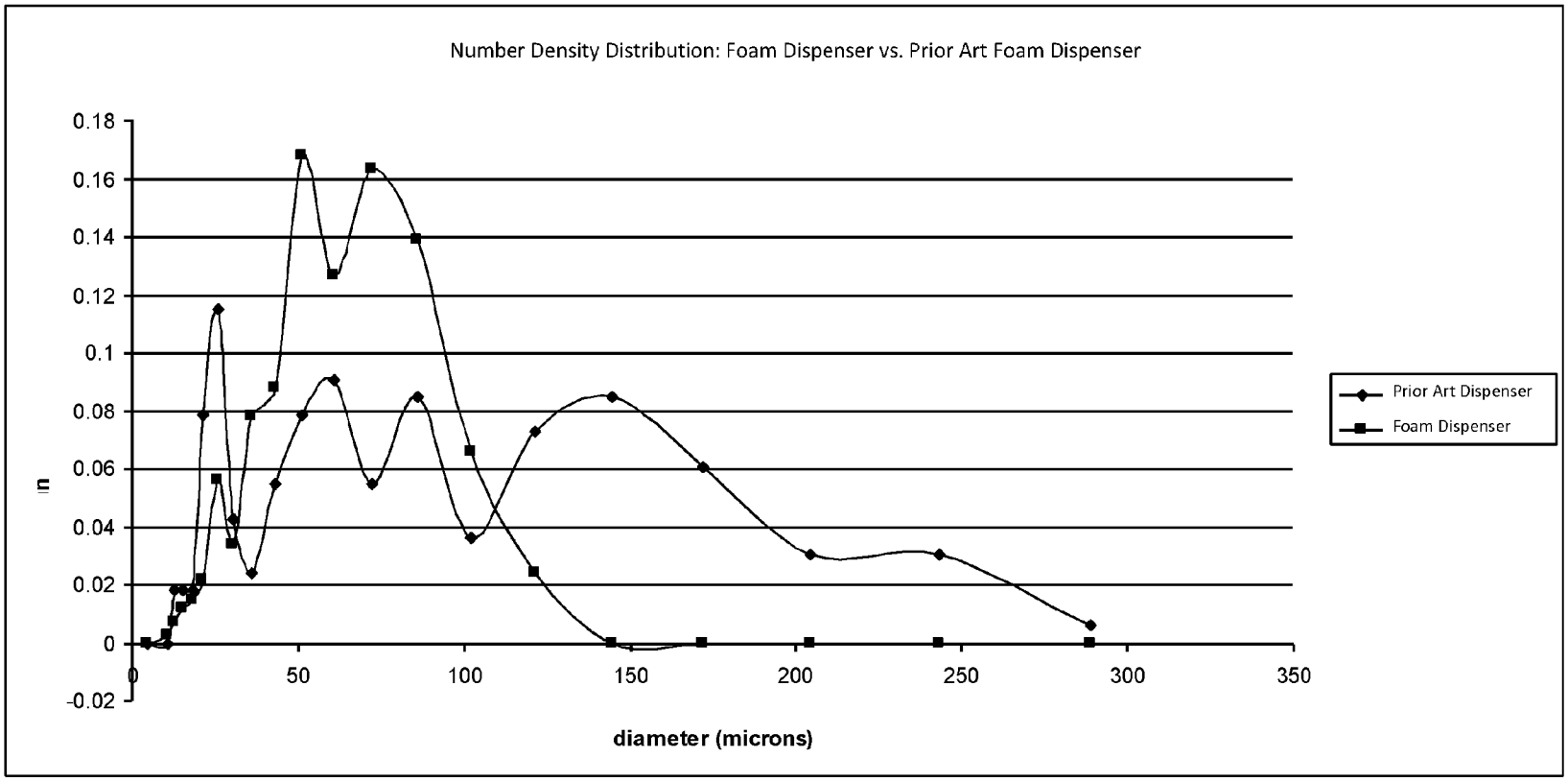
FIG. 7 is a graph showing a number density distribution for a range of bubble diameters, for the foam samples illustrated in FIGS. 5 and 6.

FIG. 7 is a graph showing a number density distribution for a range of bubble diameters for the foam sample 500 illustrated in FIG. 5 and for the foam sample 600 illustrated in FIG. 6. On the graph illustrated in FIG. 7, the x axis represents the diameter of bubbles in the foams 500, 600 measured in microns and the y axis represents the number density of bubbles with a particular diameter. The data points relating to the foam 500 illustrated in FIG. 5, generated by the prior art foam mechanism are denoted by diamond shape data points, while the data points corresponding to the foam 600, illustrated in FIG. 6, are denoted by square shaped data points. A curve fit has been added to each of the two sets of samples. As can be seen from the graph, when compared to the foam 500, the foam 600 has a greater number density of bubbles in the range of 40 microns to 100 microns, peaking around 53 microns.

Furthermore, it can be seen that the majority of bubbles in the foam sample 600 lie in the range of 40 to 100 microns. Having a large number of bubbles in this range produces a high quality foam having a "richer" texture. Furthermore, it can be seen from the graph of FIG. 7 that the standard deviation of the foam 600 is less than that of the foam 500 generated by the prior art dispensing mechanism. Having a smaller standard deviation in bubble sizes increases the homogeneity and thus quality of the foam.

Advantageously, the dispensing devices, system and foaming section described enable the creation of rich, creamy foams (high gas phase volumes of >95%, air bubbles with a preferable mean diameter of 60 microns and a narrow size distribution, preferable standard deviation: <25 microns), without the use of volatile organic compounds (VOC).

The described system, devices and sections provide better quality foams than those produced using other possible mechanisms and gases dissolved in surfactant solutions. This is because maximum gas phase volume of the foams formed using gases dissolved in surfactant solutions is typically only 4 times the volume of the liquid as this is the upper limit to the amount of gas that can be dissolved in the surfactant solution.

The described system, devices and foaming sections are also advantageous over alternative foaming devices which, for example, might involve the creation of bubbles using small apertures.

The present invention does not require machining of small apertures, which can be expensive to manufacture and often require special techniques like laser drilling. Instead, in the present invention a gas and a liquid surfactant are both forced through a foaming section having a geometry with a very large internal surface area. The liquid coats the internal surfaces of the foaming section and thus create a similarly large gas-liquid surface area. The high internal surface area to volume ratio of the present invention ensures that there is a very large surface area over which the gas and liquid phases can interact and a multitude of opportunities for the flows to be split and recombined until a smooth micro-foam is formed Unlike small orifice foaming devices where bubbles are formed via Rayleigh-Taylor instabilities at a discrete orifice and generally having a similar diameter as the orifice diameter, in the present invention bubbles produced are typically an order of magnitude smaller than the smallest orifice in the foaming section.

In certain embodiments, the smallest orifices in the dispenser are in the retaining elements (e.g. retaining elements 465, 467 shown in FIG. 4). These orifices only need to be small enough to prevent the foam enhancing elements from passing through. In contrast to the known small orifice foaming devices described in the introduction, the foam enhancing elements of the present invention can be of the order of millimeters and hence orifices in the retaining elements can be of the order of millimeters, while still allowing micro-foams to be produced.

As the present invention does not rely on bubble formation via Rayleigh-Taylor instabilities at a discrete orifice, the orifices in the retaining elements do not need to be positioned several diameters from each other therefore the retaining elements can be manufactured from low cost materials like meshes or sintered or porous material.

Also, the foam dispensing device described has a multitude of large orifices (compared to the bubble size) and a multitude of flow paths through the foaming section, and therefore the dispensing device is not prone to blockages.

Furthermore, in the foam dispensing device described the size of the air inlet is not related to the desired bubble size, so the diameter of the air inlet can be large compared to the diameter of the bubbles produced. Therefore, it is possible to entrain large quantities of gas into the surfactant liquid flow even when using modest liquid flow rates and a single air inlet. This is advantageous for creating foams with high gas phase volumes (in some cases 98% gas).

The foam dispensing device described system allows good quality micro-foams to be produced, even when subject to changes in driving pressure. For example, consistent foam quality in terms of gas bubble size, uniformity of bubble size and gas phase volume can be achieved with the present invention over a wide range of pressures, e.g. from 0.1 bar up to 10 bar, or from 0.5 bar up to 10 bar.

As illustrated in FIG. 2, in certain embodiments, the foam dispenser includes a gas inlet which remains above the liquid level of the surfactant solution, while the bifurcation at which point the gas enters the fluid conduit (manifold 31 in FIG. 2) generally remains below the liquid level. This is advantageous because a portion of the fluid conduit will remain below the liquid level, which encourages liquid surfactant solution to be drawn up the fluid conduit via capillary action. In turn, this helps to maintain some liquid surfactant solution within the fluid conduit and foaming section even when the foam dispenser has not been discharged for some time. Therefore, drying out of the fluid conduit and foaming section is avoided, which could otherwise cause blockages. In addition, the location of the bifurcation below the liquid level allows a longer two-phase flow length to be provided within the fluid conduit.

The dispensing devices, system and foaming section described can be used to generate, for example, shaving foams, cleaning foams, hair mousse, dairy foams and other food foams, industrial foams, foams for agricultural equipment, foams for medical use and pharmaceutical foams. The dispensing device 20 illustrated in FIG. 2 uses a compressed gas as a propellant and therefore the dispensing device 20 can produce a substantially continuous flow of foam when the valve is opened. This makes the dispensing device 20 particularly well suited for producing the shaving foams, hair mousse and dairy foams, where a relatively large amount of foam is often desired for use. The dispensing device 120 illustrated in FIG. 3, on the other hand, does not use a compressed gas as a propellant and therefore requires the receptacle 137 to be compressed in order to propel the surfactant solution and gas into the foaming section of the dispensing device 120. The dispensing device 120 illustrated in FIG. 3 is particularly well suited to producing cleaning foams, for example, hand soap foams, where generally a relatively smaller amount of foam is required for each use.

If this technology is used in conjunction with freezing technology (for example a refrigeration cycle, a cold temperature sink, or a low temperature phase change material) then an ice cream dispensing appliance could be made.

TABLE 1

Key Parameters: Preferable Values as indicted by initial experimentation

| # | Parameter | Value | Comments |
|---|---|---|---|
| 1 | Wetted surface area $A_{ws}$ | >1800 mm2 | This is the total surface area within the foaming section, from the bifurcation of the fluid conduit to the end of the fluid conduit (e.g. the end where the fluid conduit connects to the valve). It includes the surface area of the internal surface of the foaming section plus the surface area of any foam enhancing elements contained within the foaming section. |
| 2 | Wetted surface area to void space volume ratio | >4 $mm^2/mm^3$ | This is the surface area within the foaming section divided by the volume of free space within the foaming section. |
| 3 | Foaming section diameter | 0.1 mm < to < 10 mm (preferably less than 4 mm) | |
| 4 | Two phase flow length | >40 mm (preferably greater than 60 mm) | This is the smaller of:<br>a) the distance the gas/surfactant mixture travels from the point where the gas and surfactant solution are first brought into contact with each other to the point where the wetted surface area to void space volume reduces to (and remains) below 4 mm2/mm3<br>b) the distance the gas/surfactant mixture |

TABLE 1-continued

| Key Parameters: Preferable Values as indicted by initial experimentation | | | |
|---|---|---|---|
| # | Parameter | Value | Comments |
| | | | travels from the point where the gas and surfactant solution are first brought into contact with each other to the point of dispense (e.g. the actuator nozzle) |
| 5 | Minimum constriction size in the valve | 0.1 $mm^2$ | |
| 6 | Gas inlet diameter | 0.1 mm to 4 mm | |
| 7 | Liquid inlet diameter | 0.1 $mm^2$ to 4 $mm^2$ | |
| 8 | Surface tension of the surfactant | <50 dyne/cm | |
| 9 | Viscosity of the surfactant | <200 centiPoise | |
| 10 | Headspace pressure | 2 bar gauge to 25 bar gauge | |
| 11 | Mean diameter of bubbles in the foam | <60 microns | |
| 12 | Standard deviation of bubbles in the foam | <25 microns | |
| 13 | Maximum bubble size | <130 microns | |

Method Used to Obtain the Bubble Size Data in the Initial Experimentation

1. A sample formulation was prepared consisting of 1 part Original Fairy Liquid® and 4 parts water.
2. 100 ml of this sample was placed in a 210 ml bottle which was sealed with an aerosol valve with 3 minimum constriction size of 1 mm diameter.
3. A 60 mm tube with an internal diameter of 3.175 mm was used as the foaming section. The tube was filled with glass ballotini spheres in the size range 1-1.3 mm with a mean particle size of 1.23 mm. The total internal/wetted surface area of the system was 5294 mm2 and the wetted surface area to void space volume ratio for this mixer was 22.5 mm2/mm3. The mixer had 2.5 mm diameter circular liquid and air intakes.
4. The mixer was incorporated into the diptube of an aerosol valve with 3×1 mm constrictions.
5. The aerosol valve crimp sealed the bottle and nitrogen was used to pressurize the headspace to 5 bar gauge.
6. A sample of the foam was dispensed onto a glass microscope slide and an image was taken 3 seconds after dispense.
7. The image is shown in FIG. 6 below.
8. The bubble size distribution was determined from the image. The number density distribution is shown in FIG. 7 and was found to have a mean bubble diameter of 60 microns and a standard deviation of 25 microns (representing a standard deviation of 42% of the mean bubble diameter). The largest bubble in this image had a diameter of 130 microns. The bubble diameters were determined as the maximum length of a line that can be drawn within the enclosed curves on the image.
9. 100 ml of the sample was placed in a bottle fitted with a prior art mechanism.
10. A sample of the foam was dispensed onto a glass microscope slide and an image was taken 3 seconds after dispense.
11. The image is shown in FIG. 5 below
12. The bubble size distribution was determined from the image. The number density distribution was found to have a mean bubble diameter of 80 microns and a standard deviation of 60 microns (representing a standard deviation of 75% of the mean bubble diameter). The largest bubble in this image had a diameter of 278 microns. The bubble diameters were determined as the maximum length of a line that can be drawn within the enclosed curves on the image.

Further Experimental Work

Figure 9:
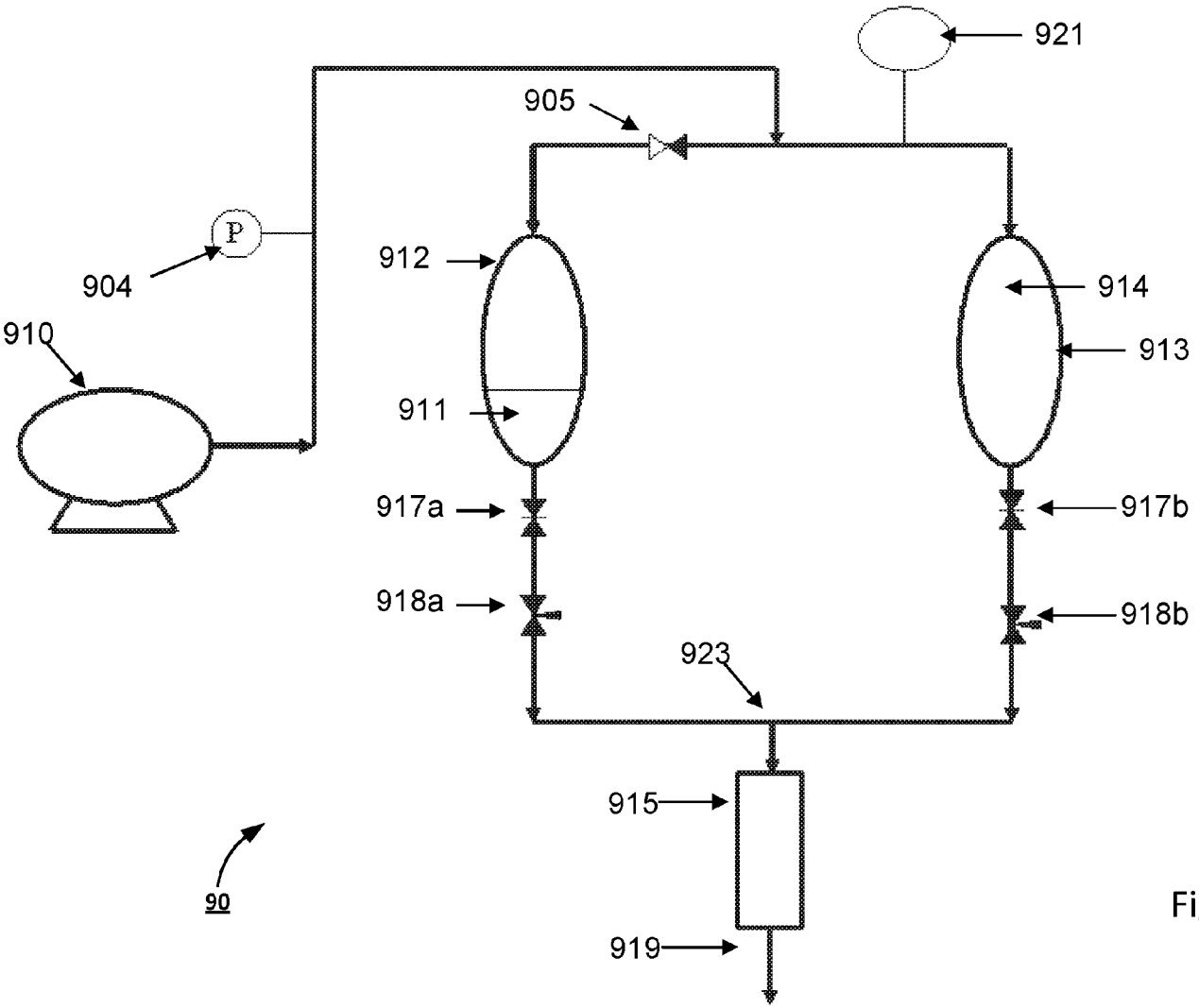
FIG. 9 is an illustration of apparatus used in experimental work relating to the dispensing device.

FIG. 9 illustrates, in simplified form, an apparatus 90 used in further experimental work. The apparatus 90 comprises an air compressor 910, a pressure regulator 904, a gas flow meter 921, a check valve 905, a liquid vessel 912 for holding liquid surfactant 911, a gas vessel 913, shut off valves 917*a* and 917*b*, needle valves 918*a* and 918*b*, a foamer device 915 (equivalent to the foaming section described previously) and an outlet 919. It will be appreciated that the apparatus 90 shown in FIG. 9 is used for experimentation, and that a practical commercial system may not include all of the elements of the apparatus 90.

The air compressor 910 is used to supply pressurized air to the liquid vessel 912 and the gas vessel 913. This pressurized air supply maintains a volume of pressurized air 914 in the gas vessel 913, and supplies air into liquid vessel 912 in order to maintain the liquid surfactant under pressure. The pressure regulator 904 controls the pressure of the air supplied by the air compressor 910.

The shut-off valve 917*a* and the needle valve 918*a* are located on an outlet line from the liquid vessel 912, while the shut-off valve 917*b* and the needle valve 918*b* are located on an outlet line from the gas vessel 913. The needle valves 918*a*, 918*b* are used to make fine adjustment to the liquid surfactant 911 and air 914 flow rates exiting the liquid and gas vessels and flowing into the foaming device 915.

The two outlet lines feed into a T-connector 923 (in a similar manner to the bifurcated tube described earlier) which combines and feeds the liquid surfactant 911 and air 914 into the foaming device 915. The liquid surfactant 911 and air 914 pass through the foaming device 915 and exit the outlet 919 of the foaming device 915.

The check-valve 905 is positioned upstream of the liquid vessel 912 to prevent liquid surfactant 911 or foam flowing through the gas flow meter 921 or into the gas vessel 913 during de-pressurization of the system.

Under certain conditions the liquid and gas exit the foaming device 915 as a micro-foam. As explained above, this is a foam in which the average bubble diameter is below 100 microns.

Under other operation conditions the liquid and gas exit the outlet as a foam with large bubbles (1-3 mm) or with intermittent spluttering of air and foam. These latter two states are undesirable for micro-foams.

Although in FIG. 9 a single foaming device is illustrated, in the further experimentation a number of different foaming devices 915 were tested. These foaming devices 915 comprised sections of tubing with lengths ranging from 20 mm up to 100 mm and diameters of 2.5 mm, 3.175 mm, 6 mm and 12 mm.

The tubing sections of the foaming devices 915 were filled with a plurality of packing elements which were selected to vary the wetted surface area Aws and porosity of the foaming device 915. The wetted surface area Aws was varied between 269 square millimeters and 4163 square millimeters. Porosities were varied between 0.38 and 0.78.

Figure 10:
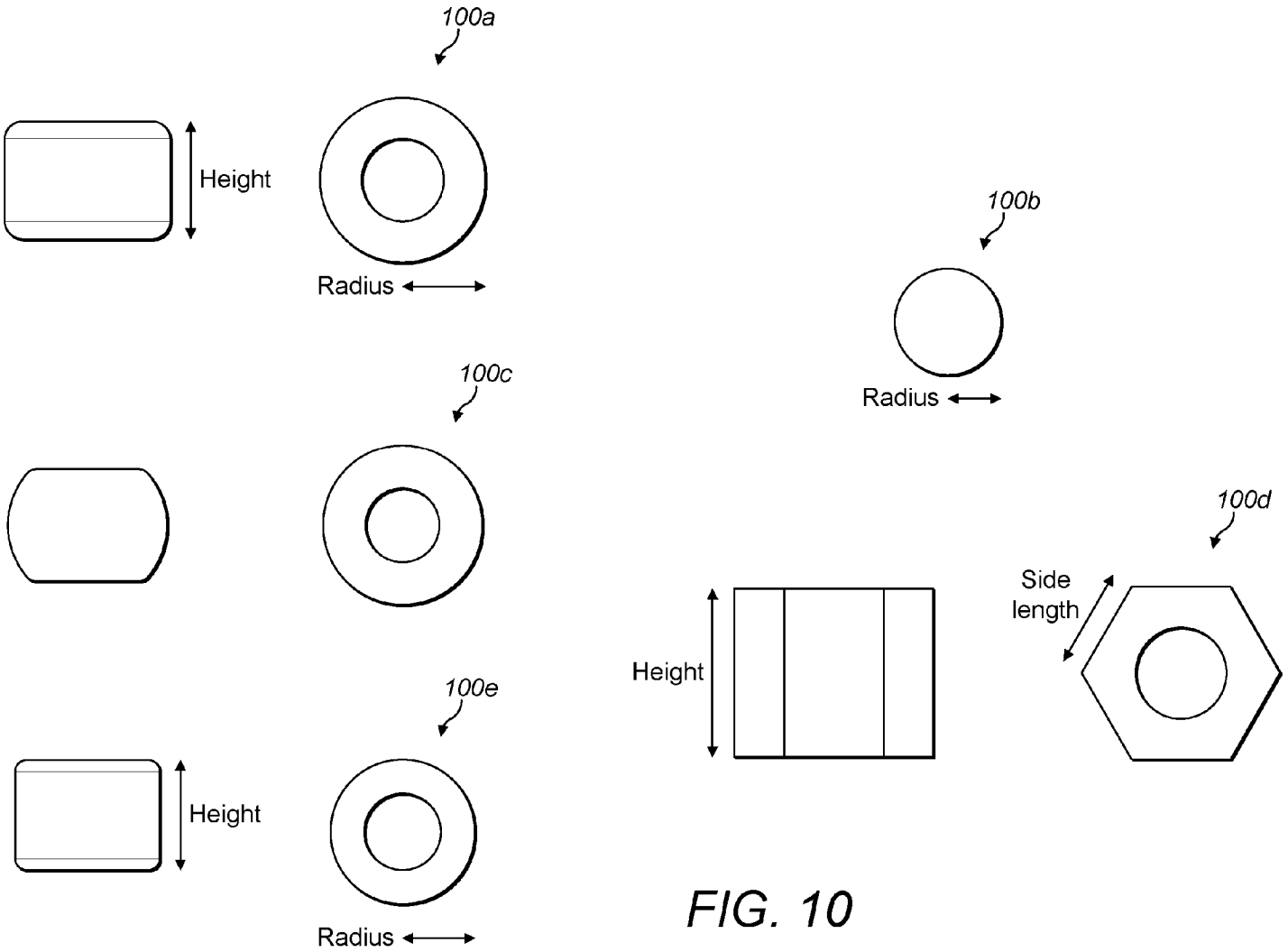
FIG. 10 is an illustration of exemplary foam enhancing elements for use in the dispensing device.

FIG. 10 illustrates some exemplary packing materials, including their key dimensions such as height 1001, radius 1002 and side length 1003. These dimensions can be used by those skilled in the art in determining the wetted surface area Aws of a foaming device 915, using known methods for calculating surface areas.

For the liquid surfactant 911, Fairy Liquid was diluted to different strengths ranging from 1 part fairy liquid:1 part water to 1 part fairy liquid:10 parts water.

Experimental Procedure

1. Each foaming device 915 was characterized in terms of: length, diameter, porosity and wetted surface area Aws.
2. The liquid vessel 912 was filled with a pre-defined volume of liquid surfactant, comprising Fairy Liquid of pre-determined dilution with water as described above.
3. The pressure regulator 904 was set to a pre-defined pressure.
4. The air compressor 910 was switched on and the shut-off valves 917*a*, 917*b* were both opened, enabling air 914 and the liquid surfactant 911 to flow through the apparatus.
5. The needle valves 918*a*, 918*b* were adjusted and different air pressures were applied by varying the settings of the pressure regulator 904, in order to identify flow rates where a micro-foam was either formed or not formed. In each case the air flow ratereading was taken from the gas flow meter. The liquid flow rate was determined by filling the liquid vessel 912 with a pre-determined volume of liquid surfactant 911 and measuring the time required to empty the vessel for particular regulator pressure and settings on the needle valves 918.
6. Step 5 was repeated with each foaming device 915 using liquid surfactant 911 comprising different dilutions of Fairy Liquid (which varies both viscosity and surface tension).
7. Furthermore, for each foaming device 915 where a micro-foam was successfully formed at step 5, the pressure regulator 904 was used to adjust the air pressure, and the needle valves 918*a*, 918*b* were adjusted to vary the level of flow restriction to determine which liquid surfactant 911 and air 914 flow rates resulted in good micro-foams, and which resulted in a poor quality micro-foam. As described above, a good quality micro-foam produced by a foaming device is generally smooth and continuous without the presence of air pockets, having for example an average bubble diameter of below 100 microns, a gas phase volume greater than 90% and a standard deviation of less than 25 microns. Examples of poor quality foams produced by foaming devices include intermittent spluttering of air and foam, liquid having large bubbles, foams consisting of large bubbles, and foams with low gas to liquid ratios.
8. Next, step 7 was repeated with each foaming device 915 using liquid surfactant 911 comprising different dilutions of Fairy Liquid.

Results

FIG. 11 is a graph illustrating the success of producing a micro-foam using a particular foaming device 915 against the key parameters of the foaming device 915. Porosity, or P, is represented on the x-axis, while parameter Y is represented on the y-axis (where Y is equal to the wetted surface area Aws multiplied by two-phase flow length LTP and divided by the total 2 volume V, which in this case has been simplified to Wetted Surface Area/Cross sectional area, or the ratio of ratio 'Rws-cs' of the wetted surface area Aws to the cross-sectional area $A_{CS}$). It was found that for some of the foaming device 915 it was not possible to create a micro-foam under any set of operating conditions. Unsuccessful foaming devices 915 for which it was found no micro-foam could be produced are indicated on the plot using circular markers, while successful foaming device 915 for which it was found a micro-foam could be produced are indicated on the plot using square markers.

As shown, it was found that successful and unsuccessful foaming devices 915 form two distinct non-overlapping clusters.

Included in the graph of FIG. 11 is a line which represents the boundary between these two clusters. The equation of the line is $y=1994(x)-821.58$ (where y is wetted surface area/cross sectional area and x is the porosity of the foaming device 915).

Therefore, foaming devices which have internal dimensions which conform to $y>1994.5x+821.58$, and where y is positive, can be successfully used to produce a micro-foam (a foam in which the average bubble diameter is below 100 microns). As those skilled in the art will appreciate, based on the graph of FIG. 12 the constants 1994.5 and 821.58 may vary by up to 10%.

FIG. 12 is a graph illustrating the success of producing a good micro-foam against the superficial velocities of the liquid surfactant 911 and the air 914. The superficial liquid velocity '$V_L$' is represented on the X-axis while the superficial gas velocity '$V_G$' is represented on the Y-axis.

As shown, it was found that good micro-foams and poor foams form two distinct non-overlapping clusters. The line $y=18.397x+507.420$ represents the boundary between these two clusters.

Therefore, when $y<18.397x+507.420$ then a good micro-foam was formed. As those skilled in the art will appreciate, based on the graph of FIG. 12 the constants 18.397 and 507.420 may vary by up to 10%.

Additionally, it was found that if all parameters of the apparatus were such that the resulting data points lay in the "good foam" regions of FIG. 12 then the apparatus formed a smooth micro-foam as long as the surface tension of the liquid surfactant 911 was below 50 dyne/cm (but preferably in the range 20-30 dyne/cm).

Furthermore, it was found that that if all parameters of the apparatus were such that the resulting data points lay in the "good foam" regions of FIG. 12 then the apparatus formed a smooth micro-foam as long as the viscosity of the liquid surfactant 911 was below 200 c.P or more preferably below 50 c.P.

Providing foaming devices in which the foaming section has internal dimensions where Rws-cs is not less than 1994 multiplied by P and minus 821 advantageously allows those skilled in the art to produce a foaming section which will successfully produce a micro-foam, by selecting appropriate configurations of the foaming device which meet this condition.

For example, if a particular parameter of the foaming section is fixed—say if the beads 100 a illustrated in FIG. 10 were used as foam enhancing elements, then selecting a foaming section with an inner diameter of 3.175 mm and with a length of 80 mm will ensure that Rws-cs is not less than 1994 multiplied by P and minus 821 and thus the foaming section will allow successful production of a micro-foam, In contrast, selecting a foaming section with an inner diameter of 3.175 mm and with a length of 60 mm will not meet the criteria that Rws-cs is not less than 1994 multiplied by P and minus 821 and thus the foaming section will not allow production of a micro-foam.

Similarly, providing foam dispenser in which VG is not more than 18.4 multiplied by VL and added to 507.4, advantageously allows those skilled in the art to produce a foam dispenser which will produce a good quality micro-foam, by selecting appropriate values of gas and/or liquid pressure or restrictions in the gas/liquid line, or surfactant liquid density or viscosity, to ensure the condition above is met.

Modifications and Alternatives

The gas used in any of the embodiments described above may comprise any suitable gas which is not liquefied at the operating pressure of the gas, which is preferably between 0.1 bar gauge and 25 bar gauge and more preferably between 2 bar gauge and 8 bar gauge and further preferably between 4 bar gauge and 6 bar gauge.

Preferably, the concentration of gas 13 in the surfactant solution 11 is 350 milligrams per kilogram of surfactant solution plus or minus 50 milligrams per kilogram, or the concentration may be less than 350 milligrams per kilogram, or less than 100 milligrams per kilogram of the surfactant solution 11.

Predefined desired characteristics may additionally or alternatively include having a target gas phase volume, meeting a target average bubble size, meeting a target standard deviation, meeting a target bubble concentration per unit volume, and/or having a target bubble size distribution.

The foaming section having foam enhancing elements as described above may additionally or alternatively be configured to produce a foam with the described desirable characteristics by providing a means for increasing the wetted surface area $A_{WS}$ of the foaming section 25, the wetted surface area to void space volume ratio of the foaming section 25 and the wetted surface area to two phase flow length ratio (see comments on parameters identified in initial experimentation in Table 1). Preferably, the foaming section 25 conforms to at least one of key parameters 1 to 4 listed in Table 1, and more preferably conforms to all of parameters 1 to 4. It will be appreciated that, in other embodiments, a similar high quality foam can be produced without the use of foam enhancing elements 53. It will also be appreciated that for any of the parameters listed in Table 1, a value can be chosen (preferably within the given preferred range) in order to produce a foam having a desired quality.

If substantially spherical foam enhancing elements are used, such as beads, then if the foam enhancing elements are all the same size then the theoretical maximum packing fraction is −0.66 and therefore the porosity is −0.33. If smaller sized beads which are all of the same diameter are used, then the set of smaller beads will have a larger surface area but the packing fraction will remain the same. However, it is possible to decrease porosity of the foaming section by increasing the polydispersity of foam enhancing elements, for example by using a mixture of different sized beads.

It will be appreciated that although in the simplified illustration of FIG. 1 the valve 17 is located downstream from the foaming section, it is possible for the value to be provided at any suitable location, for example upstream of the foaming section between the foaming section and a T or Y connector/manifold, and additionally or alternatively two or more values can be respectively provided on the gas and liquid lines, for example as illustrated in FIG. 10.

As described above, a single receptacle can be provided for containing both gas and liquid surfactant. In this case, the gas and liquid surfactant are preferably provided in a ratio which ensures that the system lies within the parametric space defined with reference to FIG. 12 where good quality foams can be produced. The gas and liquid surfactant may be converted into a coarse foam (with bubbles several mm in size or even larger) by shaking the receptacle or passing the gas and liquid surfactant through a mesh, or orifice(s) (which may be large compared to the dimensions of bubbles of the micro-foam). If the receptacle is pressurized and fed to a foaming section (with parameters lying in parametric space defined with reference to FIG. 11) then a good quality micro-foam can be produced.

Although the foam enhancing elements 53, 153, 453 have been described as generally spherical beads of glass, the foam enhancing elements may be generally spherical beads of any other suitable materials such as a plastic material, and may be beads of a different shape, for example generally cuboid, generally cylindrical or generally conical. The foam enhancing elements may alternatively comprise any other features, for example bristles or projections extending from the internal surface of the fluid conduit into the flow path of the surfactant solution and gas. It will be appreciated that in an alternative embodiment the foam enhancing elements may be formed as part of the fluid conduit itself, for example projections extending from the inner surface of the fluid conduit into the flow path of the surfactant solution and gas. Furthermore, the foam enhancing elements may alternatively comprise a single foam enhancing element, for example a porous material.

Furthermore, any combination of different types of foam enhancing elements may be used.

The foaming section 25, 125, 425 may not comprise any foam enhancing elements 52, 153,453. The foaming section may be adapted to enhance the generation of foam within the foaming section.

The foaming section may follow a serpentine, helical or other non-linear path in order to increase the length of the foaming section and to increase mixing and possibly induce turbulence in the flow of surfactant solution and gas through the fluid conduit, without greatly increasing the space the fluid conduit occupies. This is especially beneficial in embodiments where the foaming section is provided as a long thin tube without containing any foam enhancing elements.

The foaming section may be provided as a distinct section, and may be connectable to the—valve and the manifold, or to the fluid conduit parts located either side of the foaming section. The foaming section may have a narrower, or wider, diameter than the rest of the fluid conduit.

Although the retainers 65, 67, 465, 467 are described as being formed from a mesh-like material, the skilled person will appreciate that the retainers can take any suitable form provided they allow surfactant solution and gas (along with a foam comprising the surfactant solution and the gas) to pass through and also inhibit movement of the foam enhancing elements. For example, each retainer may comprise at least one aperture sized such that the foam enhancing elements cannot pass through the aperture. Specifically, the retaining element may comprise a hole which is larger than the foam enhancing elements themselves but small enough to block movement of the foam enhancing elements. It has been found that where the foam enhancing elements are beads of 1 mm in diameter, the retainer may comprise a single 1.5 mm diameter hole, where the hole is blocked by several 1 mm beads becoming trapped at its entrance.

In an alternative embodiment, no retainers are provided, and instead the foam enhancing elements are held in position in the foaming section by virtue of the friction which exists between the foam enhancing elements and the inner surface of the foaming section, and the friction between the foam enhancing elements themselves. In this alternative embodiment, the foam enhancing elements are disposed within the foaming section such that the foaming section undergoes some deformation around the foam enhancing elements, helping to hold the foam enhancing elements in place. Also, the foaming section may be resilient, and as a result exerts a compressive force on the foam enhancing elements, increasing the friction between the foaming section and the foam enhancing elements, as well as between the foam enhancing elements themselves.

In FIGS. 2, 3 and 4 it is shown that the foam enhancing elements 53, 153, 453 are disposed along part of the length of the foaming section. However, it will be appreciated by those skilled in the art that it may be advantageous to provide foam enhancing elements along substantially the full length of the foaming section.

It is described above that the foaming section 25, 125, 425 extends from the bifurcation of the fluid conduit to the end of the fluid conduit distal from the bifurcation, e.g. the point of connection between the fluid conduit and the valve. Alternatively, the foaming section may extend over substantially the entirety of the two phase flow length of the dispensing device, the two phase flow length being the distance the gas/surfactant mixture travels from the bifurcation point to the point of dispense (e.g. the actuator nozzle), as long as the wetted surface area to void space volume ratio remains above 4 mm2/mm3.

The valves referred to in the description above may comprise any type of suitable valve not limited to the types of valves illustrated in the figures.

Although in the above embodiments the gas used as a propellant has been described as compressed gas, a liquefied gas may be used instead of or in addition to a compressed gas as a propellant.

The compressed gas propellant may comprise any suitable gas, for example air, nitrogen, nitrous oxide, oxygen or noble gas. Furthermore, dissolved gas (e.g. carbon dioxide or nitrous oxide) may be used instead of or in addition to compressed gas, advantageously further enhancing the quality of the foam produced by the dispensing device.

Figure 8:
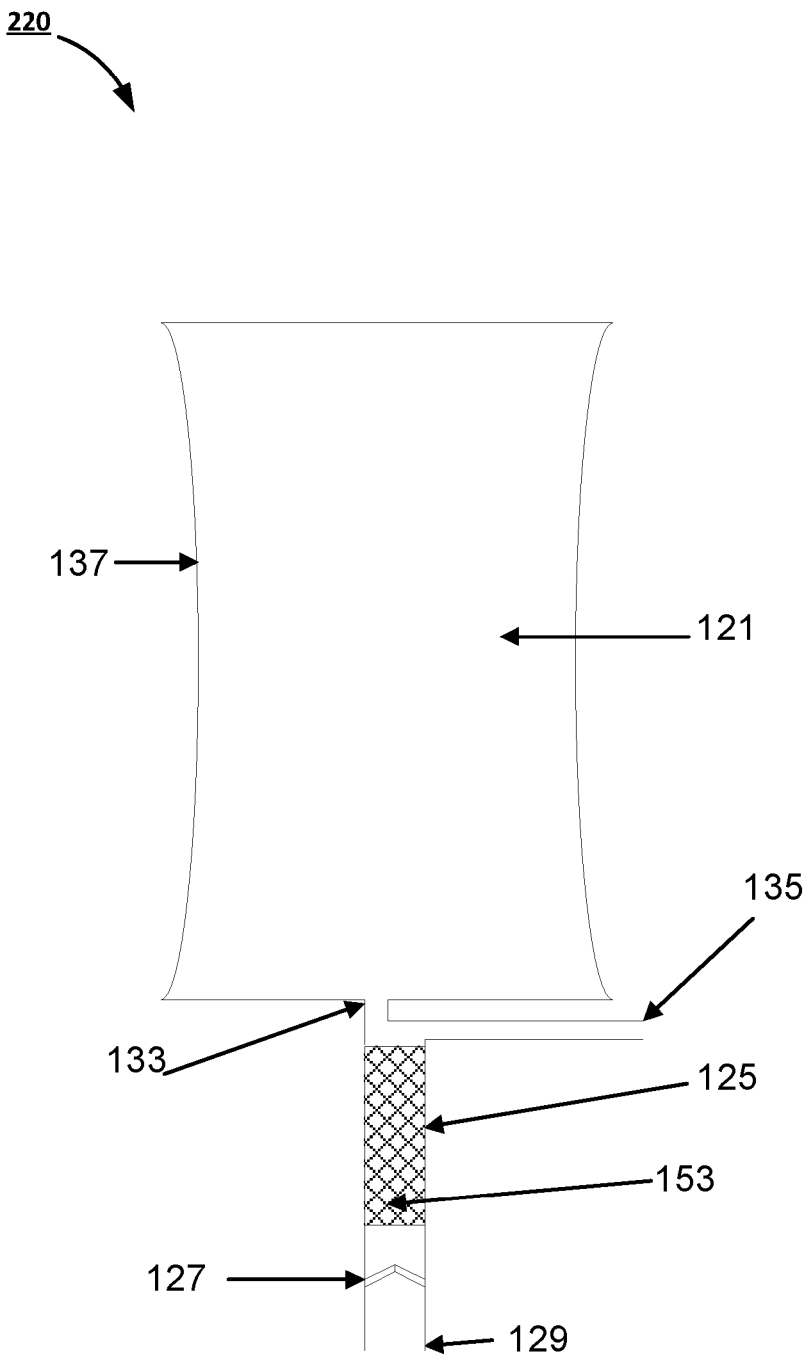
FIG. 8 is simplified illustration of a section through a dispensing device according to another embodiment.

Although FIG. 3 illustrates that the gas inlet and gas 123 are provided in the container 137, in an alternative embodiment the gas inlet may be provided externally from the container 137 as illustrated in FIG. 8. FIG. 8 is a simplified illustration of a section through a dispensing device 220 according this alternative embodiment. In this embodiment, the container 137 does not hold any substantial gas supply. Instead, the gas used to create a foam is taken from the ambient air surrounding the dispensing device 220, using the external gas inlet 135. The gas inlet 135 may include a one-way value in order to prevent air or surfactant solution from escaping from the gas inlet. This embodiment of dispensing device could be used in conjunction with a hand operated pumping mechanism in order to provide a hand operated trigger-head foamer.

The dispensing devices, system and foaming section described can be used as part of a module in a larger appliance to create foam, for example a wall mounted foam soap dispenser or a milk frother.

The dispensing devices, system and foaming section described can also be used in an air or steam driven appliance or incorporated into a disposable pod to generate foams. This would enable to generation of foams (e.g. dairy foams) without the requirement for disposable sparklets. For example, the foaming section could form part of a pod containing milk or flavoring. The pod could be inserted into an appliance, for creating a foamy milkshake or foamed milk to top a coffee.

The dispensing system, devices and the foaming section may be used to generate emulsions, comprising a suspension of globules of a first liquid within a second liquid, in which the first liquid is not miscible. The gas and liquid inlets could be used as inlets for the first and second liquids respectively. If necessary, the receptacle 37, 137 could be modified to hold the first and second liquids in separate sections. Passing the first and second liquids through a foaming section 25, 125, 425 advantageously enhances the mixing of the first and second liquids, producing a well-mixed and homogenous emulsion, with the first liquid forming small globules. In this way, it would be possible to generate emulsions on demand, such as emulsions for medical applications. This would enable generation of emulsions at the point of use and hence relax the stability requirements on many emulsion products.

Specifically, emulsions could be created on demand within an aerosol, re-usable pod or appliance, to create, for example salad dressings, skin creams, anti-microbial micro-emulsions, pharmaceutical emulsions, shampoos, conditioners and paints.

The present dispensing system, and devices may be used to produce an aerosol, comprising a suspension of liquid droplets in a gas. The surfactant solution could be replaced with a liquid for expelling as an aerosol, and a liquefied gas propellant could be used in place of or in addition to a compressed gas. Passing the liquid and gas through the foaming section would advantageously enhance mixing of the liquid gas to produce a fine aerosol of very small liquid droplets.

While the invention has been described in connection with what is presently considered to be the most practical and preferred embodiment, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A dispenser for producing a micro-foam without requiring the use of liquefied gas, from an outlet, said dispenser comprising:

a receptacle for holding a surfactant solution;

at least one gas supply member for supplying a gas, the gas supplied in a gaseous state;

a channel for conveying said surfactant solution in said receptacle and said gas along a flow path towards said outlet;

wherein said channel comprises a conduit having a foaming section for generating said foam from said surfactant solution and said gas;

wherein said foaming section has internal dimensions comprising an internal wetted surface area 'Aws', a two phase flow length $L_{TP}$, a total volume V and a porosity 'P'; and wherein said internal dimensions are characterized by a relationship between a parameter Y, the porosity 'P', and constants $K_1$ and $K_2$, the relationship being that Y is positive and not less than $K_1$ multiplied by P and minus $K_2$, wherein both constants $K_1$ and $K_2$ have values 1994 within a tolerance of 10% and 821 within a tolerance of 10% respectively; and wherein Y is equal to the wetted surface area $A_{ws}$ multiplied by the two-phase flow length $L_{TP}$ and divided by the volume V.

2. The dispenser according to claim 1, wherein said foaming section comprises at least one foam enhancing element disposed in said flow path; and wherein said internal dimensions of the foaming section are provided, at least in part, by the at least one foam enhancing element.

3. The dispenser according to claim 2, wherein said at least one foam enhancing element comprises at least one of:

a generally spherical element; a generally cuboid element; a generally cylindrical element; a generally conical element; a porous element; and an element extending from an internal surface of the foaming section into said flow path.

4. The dispenser according to claim 2, wherein said foaming section further comprises at least one retaining element for retaining the at least one foam enhancing element within the foaming section.

5. The dispenser according to claim 1, wherein said internal dimensions comprise a wetted surface area of greater than 1800 square millimeters.

6. The dispenser according to claim 1, wherein said internal dimensions comprise a wetted surface area of at least one of: greater than 3000 square millimeters; and between 4500 and 6000 square millimeters.

7. The dispenser according to claim 1, wherein said internal dimensions comprise at least one of: a wetted surface area to void space volume ratio of greater than 4 square millimeters per cubic millimeter; a wetted surface area to void space volume ratio of greater than 16 square millimeters per cubic millimeter a wetted surface area to void space volume ratio of between 20 and 25 square millimeters per cubic millimeter; a wetted surface area to two phase flow length ratio of greater than 3 square millimeters per millimeter; a wetted surface area to two phase flow length ratio of greater than $\pi$ square millimeters per millimeter; a wetted surface area to two phase flow length ratio of greater than 8 square millimeters per millimeter; a two phase flow length of greater than 40 millimeters; a two phase flow length of greater than 60 millimeters; a two phase flow length of greater than 1200 millimeters.

8. The dispenser according to claim 1 further comprising:

a source of pressure for applying pressure to the surfactant solution in said receptacle to drive said surfactant solution along said conduit and towards said foaming section and for driving foam generated by said foaming section to said outlet.

9. The dispenser according to claim 8, wherein said source of pressure is provided by said gas which is held under pressure within said receptacle.

10. The dispenser according to claim 9, wherein said gas is at least one of: held at a pressure of between 0.1 bar and 25 bar; and held at a pressure of between 0.3 bar and 8 bar.

11. The dispenser according to claim 9, wherein the concentration of said gas in said surfactant solution is less than 350 milligrams per kilogram of said surfactant solution.

12. The dispenser according to claim 1 wherein said gas comprises a non-liquefied gas.

13. The dispenser according to claim 12, wherein said non-liquefied gas comprises at least one of: air, nitrogen, carbon dioxide, one or more noble gases, nitrous oxide, oxygen.

14. The dispenser according to claim 1, wherein said channel comprises a bifurcated tube having a gas inlet and a surfactant solution inlet which meet at a point of bifurcation at which said gas and said surfactant solution mix, in operation, prior to entering the foaming section.

15. The dispenser according to claim 14, wherein said gas inlet and said surfactant solution inlet are vertically separated from one another.

16. The dispenser according to claim 14, wherein said point of bifurcation is configured to generally remain below the liquid level of the surfactant solution.

17. The dispenser according to claim 1, wherein the dispenser is configured to produce a foam without using volatile organic compounds, VOCs.

18. The dispenser according to claim 1, wherein said internal dimensions are configured to produce a micro-foam having a quality characterized by predefined limits.

19. The dispenser according to claim 18, wherein said predefined limits comprise at least one of: an average bubble diameter of less than 100 microns; an average bubble diameter of less than 60 microns; and an average bubble diameter of between 30 and 70 microns.

20. The dispenser according to claim 18, wherein said predefined limits comprise a uniformity characterised by at least one of: a standard deviation of less than 35 microns; a standard deviation of less than 25 microns; a standard deviation of between 10 and 35 microns; a standard deviation of less than 60% of the average bubble diameter; a standard deviation of less than 50% of the average bubble diameter.

21. The dispenser according to claim 1, wherein the receptacle holds a surfactant solution having at least one of: a surface tension of below 50 dyne/cm; a viscosity of below 200 c.P; a viscosity of below 50 c.P.

22. The dispenser according to claim 1, wherein said gas supply and said channel are operable to provide said gas and said surfactant solution to the foaming section with fluid characteristics comprising a superficial gas velocity '$V_G$' and a superficial liquid velocity '$V_L$';

wherein said fluid characteristics are characterized by a relationship between superficial gas velocity '$V_G$', the superficial liquid velocity '$V_L$', and constants $C_1$ and $C_2$, in which $V_G$ is not more than $C_1$ multiplied by $V_L$ and added to $C_2$, and constants $C_1$ and $C_2$ have values 18.4 within a 10% tolerance and 507.4 within a 10% tolerance respectively; and wherein $V_G$ and $V_L$ each have units of mm/sec.

23. A dispenser for producing a micro-foam from an outlet, said dispenser comprising:

a receptacle for holding a surfactant solution;

a gas supply for supplying a gas, the gas supplied in a gaseous state;

a channel said surfactant solution in said receptacle and said gas along a flow path towards said outlet;

wherein said channel comprises a conduit having a foaming section for generating said foam from said surfactant solution and said gas;

wherein said gas supply and said channel are operable to provide said gas and said surfactant solution to the foaming section with fluid flow characteristics comprising a superficial gas velocity '$V_G$' and a superficial liquid velocity '$V_L$'; and wherein said fluid flow characteristics are characterized by a relationship between superficial gas velocity '$V_G$', the superficial liquid velocity '$V_L$', and constants $C_1$ and $C_2$, in which $V_G$ is not more than $C_1$ times $V_L$ plus $C_2$ and constants $C_1$ and $C_2$ have values 18.4 within a 10% tolerance and 507.4 within a 10% tolerance respectively; and wherein $V_G$ and $V_L$ each have units of mm/sec.

24. The dispenser according to claim 22, wherein said gas supply and said channel are operable to provide said gas and said surfactant solution to the foaming section with fluid flow characteristics characterized by said relationship between superficial gas velocity '$V_G$', the superficial liquid velocity '$V_L$', and constants $C_1$ and $C_2$ by adjustment of at least one of:

a pressure applied to at least one of the gas and the surfactant solution;

a diameter of a fluid flow path.

25. A method of producing a foam without requiring the use of liquefied gas, said method comprising:

holding, in a receptacle, a surfactant solution;

conveying said surfactant solution in said receptacle and a gas from a gas supply along a flow path towards an outlet;

wherein said conveying step comprises conveying said surfactant solution and said gas in a conduit having a foaming section for generating said foam from said surfactant solution and said gas;

wherein said foaming section has internal dimensions comprising an internal wetted surface area 'Aws', a two phase flow length $L_{TP}$, a total volume V and a porosity 'P';

wherein said internal dimensions are characterized by a relationship between a parameter Y equal to the wetted surface area 'Aws' multiplied by the two phase flow length $L_{TP}$ and divided by the volume V, the porosity 'P', and constants $K_1$ and $K_2$, in which Y is positive and not less than $K_1$ multiplied by P and minus $K_2$ and constants $K_1$ and $K_2$ have values 1994 and 821 respectively within a 10% tolerance; and wherein the receptacle holding the surfactant solution is an element of a dispenser for producing a micro-foam without requiring the use of a liquefied gas from an outlet, the dispenser further comprising:

at least one gas supply member for supplying a gas, the gas supplied in a gaseous state;

a channel for conveying said surfactant solution in said receptacle and said gas along a flow path towards said outlet;

wherein said channel comprises a conduit having a foaming section for generating said foam from said surfactant solution and said gas;

wherein said internal dimensions are characterized by a relationship between a parameter Y, the porosity 'P', and constants $K_1$ and $K_2$, the relationship being that Y is positive and not less than $K_1$ multiplied by P and minus $K_2$;

wherein both constants $K_1$ and $K_2$ have values 1994 within a tolerance of 10% and 821 within a tolerance of 10% respectively; and wherein Y is equal to the wetted surface area $A_{ws}$ multiplied by the two-phase flow length $L_{TP}$ and divided by the volume V.

26. The method of producing a foam without requiring the use of liquefied gas, said method comprising:

holding, in a receptacle, a surfactant solution;

conveying said surfactant solution in said receptacle and a gas from a gas supply along a flow path towards an outlet;

wherein said conveying step comprises conveying said surfactant solution and said gas in a conduit having a foaming section for generating said foam from said surfactant solution and said gas;

wherein said gas and said surfactant solution are provided to the foaming section with fluid flow characteristics comprising a superficial gas velocity '$V_G$' and a superficial liquid velocity '$V_L$'; and wherein said fluid flow characteristics are characterized by a relationship between superficial gas velocity '$V_G$', the superficial liquid velocity '$V_L$', and constants $C_1$ and $C_2$, in which $V_G$ is not more than $C_1$ times $V_L$ plus $C_2$ and constants $C_1$ and $C_2$ have values 18.4 and 507.4 respectively within a 10% tolerance; and wherein the receptacle holding the surfactant solution is an element of a dispenser for producing a micro-foam without requiring the use of a liquefied gas from an outlet, the dispenser further comprising:

at least one gas supply member for supplying a gas, the gas supplied in a gaseous state;

a channel for conveying said surfactant solution in said receptacle and said gas along a flow path towards said outlet;

wherein said channel comprises a conduit having a foaming section for generating said foam from said surfactant solution and said gas;

wherein said internal dimensions are characterized by a relationship between a parameter Y, the porosity 'P', and constants $K_1$ and $K_2$, the relationship being that Y is positive and not less than $K_1$ multiplied by P and minus $K_2$;

wherein both constants $K_1$ and $K_2$ have values 1994 within a tolerance of 10% and 821 within a tolerance of 10% respectively; and wherein Y is equal to the wetted surface area $A_{ws}$ multiplied by the two-phase flow length $L_{TP}$ and divided by the volume V.

27. The method according to claim 25, wherein said gas and said surfactant solution are provided to the foaming section with fluid flow characteristics characterized by said relationship between superficial gas velocity '$V_G$', the superficial liquid velocity '$V_L$', and constants $C_1$ and $C_2$ by adjusting at least one of:

a pressure applied to at least one of the gas and the surfactant solution;

a diameter of a fluid flow path.

* * * * *